US005732395A

United States Patent [19]

Alexander Silverman

[11] Patent Number: 5,732,395

[45] Date of Patent: Mar. 24, 1998

[54] METHODS FOR CONTROLLING THE GENERATION OF SPEECH FROM TEXT REPRESENTING NAMES AND ADDRESSES

[75] Inventor: Kim Ernest Alexander Silverman, Danbury, Conn.

[73] Assignee: NYNEX Science & Technology

[21] Appl. No.: 790,581

[22] Filed: Jan. 29, 1997

Related U.S. Application Data

[63] Continuation of Ser. No. 641,480, Mar. 1, 1996, Pat. No. 5,652,828, which is a continuation of Ser. No. 460,030, Jun. 2, 1995, abandoned, which is a continuation of Ser. No. 033,528, Mar. 19, 1993, abandoned.

[51] Int. Cl.[6] ..... G10L 5/02

[52] U.S. Cl. ..... 704/260; 704/258; 704/266; 704/267

[58] Field of Search ..... 395/2.76, 2.69, 395/2.77, 2.65, 2.4, 2.67; 704/267, 260, 268, 256, 231, 258

[56] References Cited

U.S. PATENT DOCUMENTS

| | | | |
|---|---|---|---|
| 3,704,345 | 11/1972 | Coker et al. . | |
| 4,470,150 | 9/1984 | Ostrowski . | |
| 4,685,135 | 8/1987 | Lin et al. . | |
| 4,689,817 | 8/1987 | Kroon . | |
| 4,692,941 | 9/1987 | Jacks et al. . | |
| 4,695,962 | 9/1987 | Goudie . | |
| 4,783,810 | 11/1988 | Kroon . | |
| 4,783,811 | 11/1988 | Fisher et al. . | |
| 4,829,580 | 5/1989 | Church . | |
| 4,831,654 | 5/1989 | Dick . | |
| 4,884,972 | 12/1989 | Gasper | 395/2.69 |
| 4,896,359 | 1/1990 | Yamamoto et al. . | |
| 4,907,279 | 3/1990 | Higuchi et al. . | |
| 4,908,867 | 3/1990 | Silverman . | |
| 4,964,167 | 10/1990 | Kunizawa et al. . | |
| 4,979,216 | 12/1990 | Maisheen et al. . | |
| 5,040,218 | 8/1991 | Vitale et al. . | |
| 5,212,731 | 5/1993 | Zimmermann . | |
| 5,384,893 | 1/1995 | Hutchins . | |

OTHER PUBLICATIONS

Julia Hirschberg and Janet Pierrehumbert, "The Intonational Structuring of Discourse", *Association of Computational Linguistics*: 1986 (ACL–86) pp. 1–9.

J.S. Young, F. Fallside, "Synthesis by Rule of Prosodic Features in Word Concatenation Synthesis", *Int. Journal Man–Machine Studies*, (1980) V12, pp. 241–258.

A.W.F. Huggins, "speech Timing and Intelligibility", *Attention and Performance VII*, Hillsdale, NJ: Erlbaum 1978, pp. 279–297.

S.J. Young and F. Fallside, "Speech Synthesis from Concept: A Method for Speech Output From Information Systems", *J. Acoust. Soc. Am. 66 (3)*, Sep. 1979, pp. 685–695.

B.G. Green, J.S. Logan, D.B. Pisoni, "Perception of Synthetic Speech Produced Automatically by Rule: Intelligibility of Eight Text–to–Speech Systems", *Behavior Research Methods, Instruments & Computers*, V18, 1986, pp. 100–107.

B.G. Greene, L.M. Manous, D.B. Pisoni, "Perceptual Evaluation of DECtalk: A Final Report on Version 1.8*", *Research on Speech Perception Progress Report No. 10*, Bloomington, IN. Speech Research Laboratory, Indiana University (1984), pp. 77–127.

(List continued on next page.)

*Primary Examiner*—Tariq R. Hafiz

*Attorney, Agent, or Firm*—Michaelson & Wallace; Peter L. Michaelson; Michael P. Straub

[57] ABSTRACT

Improved automated synthesis of human audible speech from text is disclosed. Performance enhancement of the underlying text comprehensibility is obtained through prosodic treatment of the synthesized material, improved speaking rate treatment, and improved methods of spelling words or terms for the system user. Prosodic shaping of text sequences appropriate for the discourse in large groupings of text segments, with prosodic boundaries developed to indicate conceptual units within the text groupings, is implemented in a preferred embodiment.

12 Claims, 5 Drawing Sheets

OTHER PUBLICATIONS

Kim E.A. Silverman, Doctoral Thesis, "The Structure and Processing of Fundamental Frequency Contours", University of Cambridge (UK) 1987.

J.C. Thomas and M.B. Rosson, "Human Factors and Synthetic Speech", *Human Computer Interaction—INTERACT '84,* North Holland Elsevier Science Publishers (1984) pp. 219–224.

Y. Sagisaka, "Speech Synthesis From Text", *IEEE Communications Magazine,* vol. 28, iss 1, Jan. 1990, pp. 35–41.

E. Fitzpatrick and J. Bachenko, "Parsing for Prosody: What a Text–to–Speech System Needs from Syntax", pp. 188–194, 27–31 Mar. 1989.

Moulines et al., "A Real–Time French Text–To–Speech System Generating High–Quality Synthetic Speech", *ICASSP 90*, pp. 309–312, vol. 1, 3–6 Apr. 1990.

Wilemse et al, "Context Free Card Parsing In A Text–To–Speech System", *ICASSP 91*, pp. 757–760, vol. 2, 14–17 May, 1991.

James Raymond Davis and Julia Hirschberg, "Assigning Intonational Features in Synthesized Spoken Directons", *26th Annual Meeting of Assoc. Computational Lingustisics*; 1988, pp. 1–9.

K. Silverman, S. Basson, S. Levas, "Evaluating Synthesizer Performance: Is Segmental Intelligibility Enough", *International Conf. on spoken Language Processing,* 1990.

J. Allen, M.S. Hunnicutt, D. Klatt, "From Text to Speech: The MIT Talk System", *Cambridge University Press*, 1987.

T. Boogaart, K. Silverman, "Evaluating the Overall Comprehensibility of speech Synthesizers", *Proc, Int'l Conference on Spoken Language Processing*, 1990.

K. Silverman, S. Basson, S. Levas, "On Evaluating Synthetic Speech: What Load Does It Place on a Listener's Cognitive Resources", *Proc. 3rd Austal. Int'l Conf. Speech Science & Technology,* 1990.

*FIG. 4*

NAME-FIELD → COMPONENT-NAME |
COMPONENT-NAME RELATIONAL-MARKER COMPONENT-NAME

RELATIONAL-MARKER → *DOING BUSSINESS AS* |
*CARE OF* |
*ATTENTION*

COMPONENT-NAME → PREFIXED-TITLE NAME-HEAD ACCENTABLE-SUFFIX

PREFIXED-TITLE → *MISTER* | *MISSES* | *MISS* | *MIZ* | *DOCTOR* | *SAINT* | *REVEREND* |
*FATHER* | *CAPTAIN* | " "

NAME-HEAD → SUBSTANTIVE-PREFIX NAME-NUCLEUS

SUBSTANTIVE-PREFIX → CONTENT-WORD AND CONTENT-WORD | KNOWN-PREFIX | " "

KNOWN-PREFIX → *CITY OF NEW* WORD | *STATE OF NEW* WORD |
*CITY OF* WORD | *STATE OF* WORD |
*NEW YORK TELEPHONE* | *NEW ENGLAND TELEPHONE* | *NEW YORK* |
*NEW ENGLAND* | *MASSACHUSETTS* | *VERMONT* | *MAINE* |
*COMMONWEALTH OF MASSACHUSETTS*

NAME-NUCLEUS → WORD WORD* | COMPLEX-NOMINAL

COMPLEX-NOMINAL → WORD* CONTENT-WORD DEACCENTABLE-SUFFIX

ACCENTABLE-SUFFIX → *INCORPORATED* | *LIMITED* | *JUNIOR* | *SENIOR* | *THE SECOND* |
*THE THIRD* | *M D* | *P G* | *M D P C* | *ASSOCIATES* | *ASSOCIATE* |
*OF NEW YORK* | *OF BOSTON* | " "

DEACCENTABLE-SUFFIX → *COMPANY* | *COMPANIES* | *CENTER* | *CENTERS* | *SALON* |
*CORPORATION* | *SERVICE* | *SERVICES* | *ASSOCIATION* |
*ASSOCIATIONS* | *BANK* | *CARE* | *DEPARTMENT* | *INSURANCE* |
*SALES* | *SHACK* | *SHOP* | *STATION* | *SUPPLY* | *SUPPLIES* |
*SUPPLIER* | *SUPPLIERS*

CONTENT-WORD → WORD ~ (FUNCTION-WORD)

FUNCTION-WORD → *OF* | *AND* | *FOR* | *IN* | *TO* | *THE* | *A* | *AN* | *THAT* | *THIS* |

WORD → ALPHANUMERIC ALPHANUMERIC*

ALPHANUMERIC → *A* | *B* | *C* | *D* | *E* | *F* | *G* | *H* | *I* | *J* | *K* | *L* | *M* |
*N* | *N* | *O* | *P* | *Q* | *R* | *S* | *T* | *W* | *X* | *Y* | *Z* |
*0* | *1* | *2* | *3* | *4* | *5* | *6* | *7* | *8* | *9* |

Notation:

| separates alternatives
* means zero or more repetitions of preceding item
" " means null string
WORD ~ (FUNCTION -WORD) means a WORD that is not a FUNCTION-WORD
Palatino Italic text means itself

FIG. 5

| | | |
|---|---|---|
| ADDRESS-FIELD | → | ADDRESS-COMPONENT \| ADDRESS-COMPONENT COMPONENT-DELIMITER ADDRESS-FIELD |
| COMPONENT-DELIMITER | → | , |
| ADDRESS-COMPONENT | → | POST-OFFICE-BOX \| REGULAR-STREET-ADDRESS \| OTHER COMPONENT |
| POST-OFFICE-BOX | → | *POST OFFICE BOX* WORD |
| REGULAR-STREET-ADDRESS | → | UNIT-NUMBER BUILDING-NUMBER THOROUGHFARE-NAME |
| UNIT-NUMBER | → | DIGITSSTRING ALPHANUMERIC*+DIGITSTRING+ALPHANUMERIC * \| " " |
| BUILDING-NUMBER | → | COMPLEX-BLDG-NUMBER \| SIMPLE-BLDG-NUMBER \| " " |
| COMPLEX-BLDG-NUMBER | → | NUMBER-SIGN ALPHANUMERIC*+DIGITSTRING+ALPHANUMERIC * \| DIGITSTRING LINK DIGITSTRING |
| NUMBER-SIGN | → | # \| " " |
| LINK | → | - \| : |
| SIMPLE-BLDG-NUMBER | → | DIGITSTRING |
| THOROUGHFARE-NAME | → | ORDINAL WORD WORD * OPTIONAL-STREET |
| ORDINAL | → | *DIGIT*+1ST* \| *DIGIT*+2ND* \| *DIGIT*+3RD* \| *DIGIT*+(4 \| 5 \| 6 \| 7 \| 8 \| 9 \| 0)+TH* \| " " |
| OPTIONAL-STREET | → | *STREET* \| " " |
| OTHER-COMPONENT | → | CONTENT-WORD *AND* CONNTENT-WORD KNOW-PREFIX \| " " |
| WORD | → | ALPHANUMERIC + ALPHANUMERIC * |
| ALPHANUMERIC | → | *A \| B \| C \| D \| E \| F \| G \| H \| I \| J \| K \| L \| M \| N \| N \| O \| P \| Q \| R \| S \| T \| W \| X \| Y \| Z \| 0 \| 1 \| 2 \| 3 \| 4 \| 5 \| 6 \| 7 \| 8 \| 9 \|* |
| DIGITSTRING | → | DIGIT + DIGIT * |
| DIGIT | → | *0 \| 1 \| 2 \| 3 \| 4 \| 5 \| 6 \| 7 \| 8 \| 9* |

Notation:

| separates alternatives
* means zero or more repetitions of preceding item
" " means null string
+ concatenates strings
WORD ~ (FUNCTION -WORD) means a WORD that is not a FUNCTION-WORD
Palatino Italic text means itself

METHODS FOR CONTROLLING THE GENERATION OF SPEECH FROM TEXT REPRESENTING NAMES AND ADDRESSES

RELATED APPLICATIONS

This application is a continuation of U.S. patent application Ser. No. 08/641,480 filed Mar. 1, 1996, now U.S. Pat. No. 5,652,828, which is a continuation of now abandoned U.S. patent application Ser. No. 08/460,030 filed Jun. 2, 1995, abandoned, which is a continuation of now abandoned U.S. patent application Ser. No. 08/033,528 filed Mar. 19, 1993, abandoned, all of which are titled "IMPROVED AUTOMATED VOICE SYNTHESIS EMPLOYING ENHANCED PROSODIC TREATMENT OF TEXT, SPELLING OF TEXT AND RATE OF ANNUNCIATION".

BACKGROUND OF THE INVENTION

1. Field of the Invention

The present invention relates to automated synthesis of human speech from computer readable text, such as that stored in databases or generated by data processing systems automatically or via a user. Such systems are under current consideration and are being placed in use for example, by banks or telephone companies to enable customers to readily access information about accounts, telephone numbers, addresses and the like.

Text-to-speech synthesis is seen to be potentially useful to automate or create many information services. Unfortunately to date most commercial systems for automated synthesis remain too unnatural and machine-like for all but the simplest and shortest texts. Those systems have been described as sounding monotonous, boring, mechanical, harsh, disdainful, peremptory, fuzzy, muffled, choppy, and unclear. Synthesized isolated words are relatively easy to recognize, but when these are strung together into longer passages of connected speech (phrases or sentences) then it is much more difficult to follow the meaning: studies have shown that the task is unpleasant and the effort is fatiguing (Thomas and Rossen, 1985).

This less-than-ideal quality seems paradoxical, because published evaluations of synthetic speech yield intelligibility scores that are very close to natural speech. For example, Greene, Logan and Pisoni (1986) found the best synthetic speech could be transcribed with 96% accuracy; the several studies that have used human speech tokens typically report intelligibility scores of 96% to 99% for natural speech. (For a review see Silverman, 1987). The majority of these evaluations focus on segmental intelligibility: the accuracy with which listeners can transcribe the consonants and (much less commonly) vowels of short isolated words.

However, segmental intelligibility does not always predict comprehension. A series of experiments (Silverman et al, 1990a, 1990b: Boogaart and Silverman, 1992) compared two high-end commercially-available text-to-speech systems on application-like material such as news items, medical benefits information, and names and addresses. The result was that the system with the significantly higher segmental intelligibility had the lower comprehension scores, There is more to successful speech synthesis than just getting the phonetic segments right, Although there may be several possible reasons for segmental intelligibility failing to predict comprehension, the invention offers an improved voice synthesis system that addresses the single most likely cause: synthesis of the text's prosody. Prosody is the organization imposed onto a string of words when they are uttered as connected speech. It primarily involves pitch, duration, loudness, voice quality, tempo and rhythm. In addition, it modulates every known aspect of articulation. These dimensions are effectively ignored in tests of segmental intelligibility, but when the prosody is incorrect then at best the speech will be difficult or impossible to understand (Huggins, 1978), at worst listeners will misunderstand it without being aware that they have done so.

The emphasis on segmental intelligibility in synthesis evaluation reflects long-standing assumptions that perception of speech is data-driven in a bottom-up fashion, and relatedly that the spectral modeling of vowels, consonants, and the transitions between them must therefore be the most impoverished and important component of the speech synthesis process. Consequently most research in speech synthesis is concerned with improving the spectral modeling at the segmental level, In the present invention however, comprehensibility of the text synthesis is improved, inter alia, by addressing the prosodic treatment of the text, by adapting certain prosodic treatment rules exploiting a priori characteristics of the text to be synthesized, and by adopting prosodic treatment rules characteristic of the discourse, that is, the context within which the information in the text is sought by the user of the system. For example, as in the preferred embodiment discussed below, name and address information corresponding to user-inputted telephone numbers is desired by that user. The detailed description below will show how the text and context can be exploited to produce greater comprehensibility of the synthesized text.

2. Description of the Prior Art

In the prior art typical text-to-speech systems are designed to cope with "unrestricted text" (Allen et al, 1987). Synthesis algorithms for unrestricted text typically assign prosodic features on the basis of syntax, lexical properties, and word classes. This often works moderately well for short simple declarative sentences, but in longer texts or dialogs the meaning is very difficult to follow. In a system designed for unrestricted text, it is difficult to infer the information structure of the text and how it relates to the prior knowledge of the speaker and hearer. The approach taken in these systems to generating the prosody has been to derive it from an impoverished (i.e. significantly more limited than than the theoretical possibility) syntactic analysis of the text to be spoken. For example, prior art systems have prosody confined to simple rules designed into them, such as:

1. Content words receive pitch-related prominence, function words do not. Hence the prominences (indicated in bold) in a sentence such as:
   synthetic speech is easy to understand
2. Small boundaries, marked with pitch falls and some lengthening of the syllables on the left, are placed wherever there is a content word on the left and a function word on the right. Hence the boundaries (indicated with |):
   synthetic speech | is easy | to understand
3. Larger boundaries are placed at punctuation marks. These are accompanied by a short pause, and preceded by either a falling-then-rising pitch shape to cue non-finality in the case of a comma, or finality in the case of a period.
4. Pitch is relatively high at the start of a sentence, and declines over the duration of the sentence to end relatively lower at the end. The local pitch excursions associated with word prominences and boundaries are superposed onto this global downward trend. The global trend is called declination. It is reset at the start of every sentence, and may also be partially reset at punctuation marks within a sentence.

5. There are several ways in which minor deviations from the above principles can be implemented to add variety and interest to an intonation contour. For example in the MITalk system, which is the basis for the well-known DECtalk commercial product, the extent of prominence-lending pitch excursions on content words depends on lexical properties of the word: interrogative adjectives are assigned more emphasis (higher pitch targets), verbs are assigned the least (lower targets), and so on.

Different state-of-the-art synthesizers all use basically the same approach, each with their own embellishments, but the general approach is that the prosody is predicted from the intrinsic characteristics of the to-be-synthesized text. This is a necessary consequence of the decision to deal with unrestricted text. The problem with this approach is that prosody is not a lexical property of English words—English is not a tone language. Neither is prosody completely predictable from English syntax—prosody is not a redundant encoding of surface grammatical structure.

Rather, prosody is used by speakers to annotate the information structure of the text string. It depends on the prior mutual knowledge of the speaker and listener, and on the role a particular utterance takes within its particular discourse. It marks which words and concepts are considered by the speaker to be new in the dialogue, it marks which ones are topics and which ones are comments, it encodes the speaker's expectations about what the listener already believes to be true and how the current utterance relates to that belief, it segments a string of sentences into a block structure, it marks digressions, it indicates focused versus background information, and so on. This realm of information is of course unavailable in an unrestricted text-to-speech system, and hence such systems are fundamentally incapable of generating correct discourse-relevant prosody. This is a primary reason why prosody is a bottleneck in speech synthesis quality.

Commercially available synthesizers contain the capability to execute prosody from indicia or markers generated from the internal prosody rules. Many can also execute prosody from indicia supplied externally from a further source. All these synthesizers contain internal features to generate speech (such as in section 32 of the synthesizer 30 of FIG. 1) from indicia and text. In some, internally derived machine-interpretable prosody indicia based on the machine's internal rules (such as may be generated in section 31 of the synthesizer 30 of FIG. 1) are capable of being overridden or replaced or supplemented. Accordingly, one object of the invention in its preferred embodiment is achieved by providing synthesizer understandable prosody indicia from a supplemental prosody processor, such as that illustrated as preprocessor 40 in FIG. 2 to supplant or override the internal prosody features. Since most real applications of language technology only deal with a constrained topic domain, the invention exploits these constraints to improve the prosody of synthetic speech. This is because within the constraints of a particular application it is possible to make many assumptions about the type of text structures to expect, the reasons the text is being spoken, and the expectations of the listener, i.e., just the types of information that are necessary to determine the prosody. This indicates a further aim of the invention, namely, application-specific rules to improve the prosody in a given text-to-speech synthesis application.

There have been attempts made in the past to use the discourse constraints of an application context to generate prosody. Significant pieces of work include:

1. Steven Young and Frank Fallside (Young and Fallside, 1979, 1980) built an application that enabled remote access to status information about East Anglia's water supply system. Field personnel could make telephone calls to an automated system which would answer queries by generating text around numerical data and then synthesizing the resulting sentences. All the desired prosody markers were hand-generated along with the text, and hand-embedded within it rather than being generated automatically on an automated analysis of the text.
2. Julia Hirschberg and Janet Pierrehumbert (1986) developed a set of principles for manipulating the prosody according to a block structure model of discourse in an automated tutor for the vi (a standard text editor). The tutoring program incorporated text-to-speech synthesis to speak information to the student. Here too, however, the prosody was a result of hand-coding of text rather than via an automated text analysis.
3. Jim Davis (1988) built a navigation system that generated travel directions within the Boston metropolitan area. Users are presented with a map of Boston on a computer screen: they can indicate where they currently are, and where they would like to be. The system then generates the text for directions for how to get them. In one version of the system, elements of the discourse structure (such as given-versus-new information, repetition, and grouping of sentences into larger units) were imbedded directly in the text by the designer to represent accent placement, boundary placement, and pitch range, rather than being generated by a automated marker generation scheme.

The inventor (see U.S. Pat. No. 4,908,867) has also developed a set of rules to incorporate some aspects of discourse structure into synthetic prosody to improve unrestricted text prosody. Some rules systematically varied pitch range to mark such phenomena as the scope of propositions, beginnings and ends of speaker turns, and hierarchical groupings of prosodic sentences. Other rules used a FIFO buffer of the roots of content words to model the listener's short-term memory for currently-evoked discourse concepts, in order to guide the placement of prominences. Still others used phrasal verbs to correct prosodic boundaries (to correctly distinguish, for instance, between "Turn on | a light" and "Turn | on the second exit"), and performed deaccenting in complex nominals (to give different prosodic treatment, for instance, to "Buildings Galore" as opposed to "Building Company"). These rules were put to a formal evaluation: they were used to synthesize a set of multi-sentence, multi-paragraph texts from a number of different application domains (such as news briefs, advertisements, and instructions for using machinery). Each text was designed such that the last sentence of one paragraph could alternatively be the first sentence of the next paragraph, with a consequent well-defined change in the overall meaning of the text. Twenty volunteers heard one or other version of each text, with the crucial difference marked by the prosody rules, and answered comprehension questions that focused on how they had understood the relevant aspects of the overall meaning. The prosody was found to predict the listeners' comprehension 84% of the time.

However, it remains unclear whether similar prosodic phenomena will influence perception of synthetic speech with real users rather than volunteers, on less controlled and more variable material, in a real-world application. This has theoretical implications—the importance of prosodic organization in models of speech production should reflect its pervasiveness in speech perception—as well as practical implications for effectively exploiting speech synthesis to facilitate remote access to information. For these reasons, this invention addresses prosodic modeling in the context of an existing information-provision service. As can be seen, no automated prosody generation feature (capable of automatically analyzing text,) had been yet provided to exploit the particular characteristics of restricted text and the dialog with the user to improve the prosody performance of the then state-of-the-art synthesis devices.

Taking these considerations into account, a speech synthesis system according to the invention has been achieved with the general object of exploiting—for convenience—the existing commercially available synthesis devices, even though these had been designed for unrestricted text. As a specific object, the invention seeks to automatically apply prosodic rules to the text to be synthesized rather than those applied by the designed-in rules of the synthesizer device. More specifically, the invention has the more specific object of utilizing prosody rules applied to an automated text analysis to exploit prosodic characteristics particular to and readily ascertainable from the type and format of the text itself, and from the context and purpose of the discourse involving end-user access to that text. Moreover, improved adaptive speaking rate and enhanced spelling features applicable to both restricted and unrestricted text are provided as a further object. The following discussion will make apparent how these objects may be achieved by the invention, particularly in the context of a preferred embodiment: a synthesized name and address application in a telephone system.

SUMMARY OF THE INVENTION

The invention and its objects have been realized in a name and address application where organized text fields of names and addresses are accessed by user entry of a corresponding telephone number. The invention makes use of the existence of the organized field structure of the text to generate appropriate prosody for the specific text used and the intended system/user dialog. As is known, however, systems of this type need not necessarily derive text from stored text representations, but may synthesize text inputted in machine readable form by a human participant in real time, or generated automatically by a computer from an underlying database. Thus the invention is not to be understood to be merely limited to the telephone system of the preferred embodiment that utilizes stored text. However, in accordance with the invention, prosody preprocessing is provided which supplants, overrides or complements the unrestricted-text prosody rules of the synthesizer device containing built-in unrestricted-text rules. Additionally, the invention embodies prosody rules appropriate for the use of restricted text that may, but need not necessarily be embodied in a preprocessing device. Nonetheless, in the preferred embodiment discussed, it is contemplated that preprocessing performed by a computer device would generate prosody indicia on the basis of programming designed to incorporate prosody rules which exploit the particularities of the data text field and the context of the user/synthesizer dialog. These indicia are applied to the synthesizer device which interprets them and executes prosodic treatment of the text in accordance with them.

In the name and address synthesis in the preferred embodiment, a software module has been written which takes as input ASCII names and addresses, and embeds markers to specify the intended prosody for a well-known text-to-speech synthesizer, a DECtalk unit. The speaking style that it models is based on about 350 recordings of telephone operators saying directory listings to real customers. It includes the following mappings between underlying structure and prosody:

* De-accenting in complex nominals
  (e.g. "Building Company" and "Johnson's Hardware Supply", but not in "Johnson's Hardware and Supply")
* Boundary placement around conjunctions
  (e.g. "[A and P][Tea Company]" versus "[S Jones][and C Smith]")
* Reducing the prosodic salience of inferable markers of information-structure
  (e.g., "Joe Citizen [doing business as] Citizen Watch")
* Resolving numerical adjacency
  ("100 24th Ave" versus "120 4th Ave" versus "124th Ave")
* Bracketing
  (e.g. "[Smith-Enterprises Incorporated][in Boston]" should not be "[Smith Enterprises][Incorporated in Boston]")
* Prosodic separation of sequenced information units
  (e.g. "[Suite 20][3rd Floor][400 Main Street]")
* Overall prosodic shaping of a discourse turn
  Raising overall pitch range at the starts of turns and topics;
  Lowering it at the end of the final sentence;
  Speeding up during redundant information;
  Slowing down for non-inferable material;
  Systematic variation of pause duration according to the length of the prepausal material.
* Strategies for explicit spelling
  Prosodic groupings of letters into phrases.
  Choice of when and how to spell letters by analogy.
  (e.g. "Silverman" will start with "S for Samuel", but "Samuel" will start with "S for Sierra", and "Smith" or "Sherman" would start with plain "S").
* Interactive adaptation of speaking rate
  On the basis of user requests for repeats of the material.
  Speaking rate is modelled at three different levels, to distinguish between a particularly difficult listing, a particularly confused listener, and consistent confusion across many listeners.

In the following Detailed Description, the implementation of the above principles will be elaborated in greater detail, and the nomenclature used for that elaboration in general will include that of the fields of natural language processing and speech science, such as that used in the prior art references discussed above. For example, "nominal", "salience" and "discourse turn" and "prosodic boundary" would have the generally understood meaning of those fields. In those fields, salience is known to be indicated by changes of pitch, loudness, duration and speaking rate. Prosodic boundaries are known to be indicated by silence, lengthening and pitch change, pitch change alone, or pitch change and lengthening. It will therefore be appreciated to those skilled in the art that the preferred embodiment may be implemented in a ways utilizing alternative prosodic effects while remaining within the spirit and scope of the invention.

The Detailed Description first discusses the prosodic principles and effects desired for the preferred embodiment of the invention, and thereafter discusses in greater detail the manner of implementation of those principles and effects.

DESCRIPTION OF THE DRAWINGS

The following description will be with reference to the accompanying drawings in which:

FIGS. 4 and 5 show the context-free grammars useful to generate machine instructions for the prosodic treatment of the respective name and address fields according to the preferred embodiment.

DETAILED DESCRIPTION OF A PREFERRED EMBODIMENT

Figure 1:
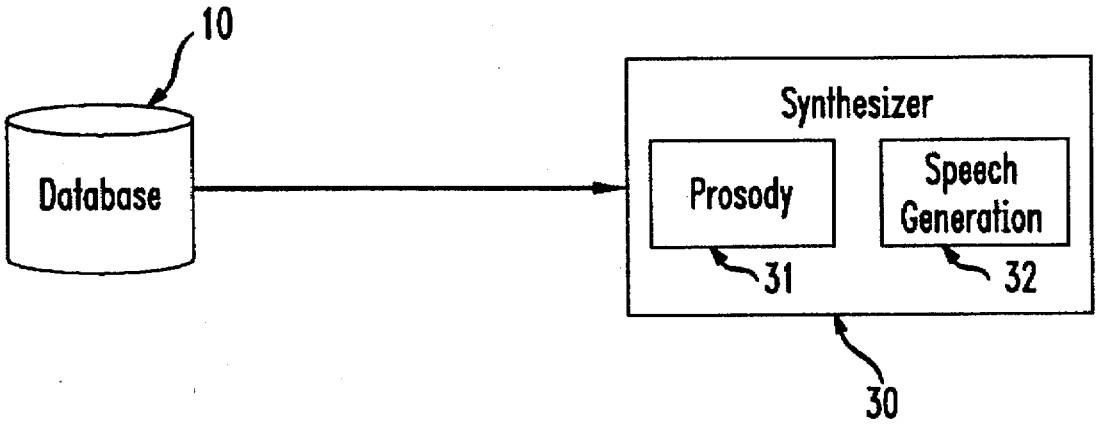
FIG. 1 Prior Art
FIG. 1 illustrates the general environment of the invention and will be understood as representative of prior art synthesis systems.

In the following detailed description of a preferred embodiment, a realization of the invention will be disclosed which has been developed using commercially available constituents. For example, the discussed synthesizer device employed in that realization is the widely known DECtalk device which has long been commercially available. That device has been designed for converting unrestricted text to speech using internally-derived indicia, and has the capability of receiving and executing externally generated prosody indicia as well. The unit is in general furnished with documentation sufficient to implement generation and execution of most of such indicia, but for some aspects of the present invention, as the specification teaches, certain prosodic features may have to be approximated. This device was nonetheless chosen for the reduction to practice of the invention because of its general quality, product history and stability, as well as general familiarity. However it is to be understood that the invention can be practiced using other such devices originally designed, or modifiable to be able to use, the prosodic treatment of the text contemplated by the preferred embodiment of the present invention. Indeed, other state-of the art units are now on the market or near to entering the market which may perhaps be preferably employed in future realizations of the invention. Such other conceivable units include those provided by AT&T, Berkeley Speech Technology, Centigram and Infovox. Additionally, technology and technical information useful for possible future developments would be available from Bellcore (Bell Communications Research, Inc.).

The prosody algorithms used to preprocess the text to be synthesized by the DECtalk unit were programmed in C language on a VAX machine in accordance with the rules discussed below in the Detailed Description and in conformance with the context-free grammars of FIG. 4 et seq.

The application described for a preferred embodiment is names and addresses, For a number of reasons, this is an appropriate text domain for showing the value of improving prosody in speech synthesis. There are many applications that use this type of information, and at the same time it does not appear to be beyond the limits of current technology. But at first sight it would not appear that prosody enhancement would significantly help a user to better comprehend the simple text. Names and addresses have a simple linear structure. There is not much structural ambiguity (although a few examples will be given below in the discussion of the prosodic rules), there is no center-embedding, no relative clauses. There are no indirect speech acts. There are no digressions. Utterances are usually very short. In general, names and addresses contain few of the features common in cited examples of the centrality of prosody in spoken language. This class of text seems to offer little opportunity for prosody to aid perception.

Nonetheless, the invention has shown prosody to influence synthetic speech quality even on such simple material as names and addresses. This implies it is all the more likely to be important in other information-provision domains where the material is more complex, such as weather reports, travel directions, news items, benefits information, and stock quotations. Some example applications that require names and addresses include:

Deployment of Field Labor Forces: field marketing or service personnel are often unable to predict precisely how long they will need to spend at a customer's premises or how long it will take to travel between appointments. In order to more efficiently deploy these forces, many organizations require field staff to phone in to a central business office when they finish at one location. They are then given the name and address of the next customer to visit, based on their current location and the time of day. Hence, for example, a staff member who is ahead of schedule can fill in for one who is behind. However, the cost of this procedure is that a staff of operators must be maintained at the central business office to answer the phone calls from the field personnel and tell them the names and addresses that they are next to visit. This expensive overhead could be significantly reduced if the information were spoken by speech synthesis.

Order and Delivery Tracking: A major nationwide distributor of goods to supermarkets maintains a staff of traveling marketing representatives. These visit supermarkets and take orders (for so many cartons of cookies, so many crates of cans of soup, and such). Often they are asked by their customers (the supermarket managers) such questions as why goods have not been delivered, when delivery can be expected, and why incorrect items were delivered. Up until recently, the representatives could only obtain this information by sending the order number and line item number to a central department, where clerks would type the details into a database and see the relevant information on a screen. The information would be, for example: "Five boxes of Doggy-o pet food were shipped on January the 3rd to Bill's Pet Supplies at 500 West Main Street, Upper Winthrop, Me. They were billed to William Smith Enterprises at 535 Station Road, Lower Winthrop." The clerks would then speak the contents of the screen onto an audio cassette and post this recording to the marketing representative, who would receive it several days or even a week later. Such applications make the information available immediately and more accurately (since there would be no more problems of clerks providing incorrect information), and therefore provide more timely feedback to customers and would not need the staff of clerks at the central location.

Bill Payment Location: One of the other services may be provision of the name and address of the nearest place where customers can pay their bills. Customers call an operator who then reads out the relevant name and address. This component of the service could be automated by speech synthesis in a relatively straightforward manner.

CNA (Customer Name and Address) Bureau: Each telephone company is required to maintain an office which provides the name and address associated with subscribers' telephone numbers. Customers are predominantly employees of other telephone companies seeking directory information: over a thousand such calls are handled per day.

From the above examples, it is clear that synthesis of names and addresses is strategic for cost reduction, service quality improvement, increased availability, and revenue generation. There has been a consensus in the industry concerning the importance of names and addresses, which has prompted a considerable investment over many years in solving the problems of synthesizing this type of material.

A. Prosodic Characteristics of the Name and Address Fields

1. General Considerations

All human speech perception relies heavily on context to aid in deriving the meaning from the acoustic signal. Syntactic, semantic, and situational constraints strongly limit alternative interpretations of phonemes, words, phrases, and meanings, by rendering incorrect inferences unlikely. In the speech recognition field, this is expressed as reducing the perplexity: i.e. the average number of choices to be made at any point in the utterance. In the case of names and addresses, perplexity is extremely high. For example, knowing that a person's given name is "Mary" does not significantly help predict her surname. There are millions of possible people's name, street names, and town names. In general, the low predictability and lack, of such contextual constraints requires high intelligibility in synthetic speech.

High intelligibility is even more important when the names and addresses are to be synthesized over the telephone network. The bandwidth reduction, spectral distortion, and additive noise of the network characteristics conspire together to mask and degrade the acoustic signal, thereby requiring more mental processing by the listener who is trying to recover the meaning from the impoverished signal. A recent study (ICSLP, 1992) that used 600 names and addresses showed that the bandwidth reduction alone more severely degrades synthetic speech than it does natural human speech.

In addition to the need for high intelligibility, names and addresses present enormous problems for pronunciation rules. In General English it is difficult enough to predict how a word ought to be pronounced on the basis of its spelling (consider the 7 different vowels represented by -ough- in though, through, tough, cough, thought, thorough, and plough), but names are even more difficult. There has been much work (Church, 1986; Vitali, 1988; Spiegel, 1990; Golding, 1991) in this area, and much progress has been made.

While it is true that the above problems are serious and must be adequately addressed in any name-and-address application, the question remains concerning whether these are the only major problems. There seems to be an underlying assumption in the art, as indicated in the literature, that a synthesizers' default prosody rules, such as those designed for the general case of unrestricted text, are of relatively minor importance in this domain: as long as they are generally "adequate" they will not seriously impinge on synthesizer performance for this class of text. This assumption is reflected in the continued attention paid to segmental intelligibility and name pronunciation, and the relatively little attention paid to prosodic modeling. This represents a situation that can benefit from improved prosodic treatment.

2. Discourse Characteristics of the Preferred Embodiment

Figure 2:
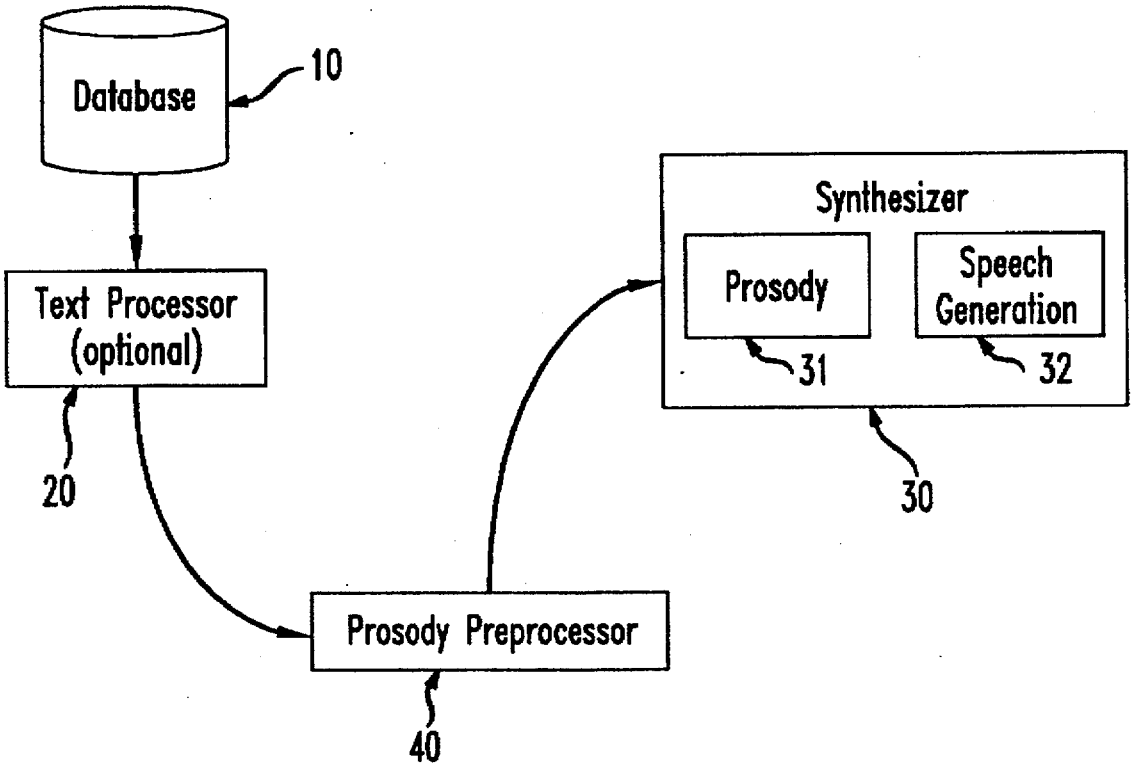
FIG. 2 illustrates how the invention is to be utilized in conjunction with the prior art system of FIG. 1.

In the preferred embodiment, shown in FIG. 2, the name and address text corresponding to the telephone numbers have been arranged into fields and the text edited to correct some common typing errors, expand abbreviations, and identify initialisms. If this is not done a priori manually, listings may be passed through optional text processor 20 before being sent to the synthesizer 30 in order to be spoken for customers. The editing may also arrange the text into fields, corresponding to the name or names of the subscriber or subscribers at that telephone listing, the street address, street, city state and zip code information. Neither a text processing feature nor particular methods of implementing it are considered to be part of the present invention.

In the preferred embodiment telephone CNA system, certain relevant aspects of the text and the context of the dialogue have been considered for the prosody rules implemented by preprocessor 40, and implemented in the software associated with that function, and generating indicia of prosody which is executable by a DECtalk unit, In the CNA systems like that considered for the preferred embodiment, callers to the CNA bureau know the nature of the information provision service, before they call. They have 10-digit telephone numbers, for which they want the associated listing information. At random, their call may be handled by an automated system like that of the preferred embodiment, rather than a human operator. The dialogue with the automated system consists of two phases: information gathering and information provision. The information-gathering phase uses standard Voice Response Unit technology: users hear recorded prompts and answer questions by pressing DTMF keys on their telephones. This phase establishes important features of the discourse:

Callers must supply a security access code, This establishes much of the mutual knowledge that defines discourse relevance (in the Gricean sense): users are aware of the topic and purpose of the discourse and the information they will be asked to supply by the interlocutor (in this case the automated voice). Users are likely to be experienced in that particular information service, and so are probably even aware of the order in which they will be asked to supply that information.

Callers key in the telephone numbers for which they want listing information. This establishes explicitly that the keyed-in telephone numbers are shared knowledge: the interlocutor knows that the caller already knows them, the caller knows that the interlocutor knows this, the caller knows that the interlocutor knows this, and so on. Moreover, it establishes that the interlocutor can and will use the telephone numbers as a key to indicate how the to-be-spoken information (the listings) relates to what the caller already knows (thus "555-2222 is listed to Kim Silverman, 555-2929 is listed to John Q. Public"). These features very much constrain likely interpretations of what is to be spoken, and similarly define what the appropriate prosody should be in order for the to-be-synthesized information to be spoken in a compliant way.

The second phase of the user/system dialog is information provision: the listing information of names and addresses for each telephone number is spoken by the speech synthesizer in a continuous linguistic group defined as a "discourse turn". Specifically, the number and its associated name and town are embedded in carrier phrases, as in:

<number> is listed to <name> in <town>

The resultant sentence is spoken by the synthesizer, after which a recorded human voice says:

"press 1 to repeat the listing, 2 to spell the name, or # to continue"

If the caller requests a repeat, then all that is synthesized is:

<name> in <town>

If the caller requests spelling, then it is synthesized one word at a time, as in:

Kim K-I-M Silverman S-I-L-V-E-R-M-A-N

In addition, there are additional messages to be spoken by the synthesizers. The most relevant of these concerns auxiliary phone number, as in when a given telephone number is billed to different one, as in:

The number <number> is an auxiliary line. The main number is <number>. That number is listed to <name> in <town>.

3. Prosodic Objectives

In the preferred embodiment of the invention this above-described dialog and the identified text are treated prosodically by rules—discussed in greater detail below—that address the following aspects particularly associated with the dialog and text characteristics. Thus the rules are designed to the following considerations:

Separation of name words. In normal fluent connected speech people tend to run words together, allowing phonetic coarticulation, assimilation, deletion, and elision processes to operate across word boundaries within intonational phrases. Listeners are able to locate the word boundaries because of the contextual constraints described earlier. However in names this is much more difficult, and so if names are spoken in the same style then it can be difficult to detect where one word ends and the next begins. Thus for example the inventor's name, "Kim Silverman", sounds like "Kimzel Vermin" when pronounced by DECtalk (version 2.0), under only the prosody rules designed into that device for unrestricted text. Native speakers intuitively are aware of this characteristic of names and so usually when recording their name (on telephone answering machines, for example) will tend to separate the words somewhat.

Boundaries before accented suffixes. Residential and business names often have postfixes such as "Incorporated", "Senior", or "the Second". These are normally prosodically separated from the preceding name, almost as if spoken as an afterthought. They function as a modifier on the preceding item.

Boundaries around major conjunctions. Strings that separate two names, and rather than being part of either name merely indicate the nature of the relationship between them, should be prosodically separated from their arguments. These include ". . . doing business as . . . ", ". . . care of . . . ", and ". . . attention . . . ".

De-accenting in complex nominals. As described the default or designed-in prosody behavior of synthesizers designed for unrestricted text is typically to assign a prominence-lending pitch movement (henceforth pitch accent) to every content words. This leads to many more pitch accents in synthetic speech than in natural human speech. One of the most egregious errors of this type is in certain complex nominals. Complex nominals in general are strings of nouns or adjective-noun sequences that refer to a single concept and function as a noun-like unit. A large subset of these require special prosodic treatment, and have been the topic of much linguistic research. Common examples from normal language include "elevator operator", "dress code", "health hazard", "washing machine", and "disk drive". In each of these examples the right-hand member is less prominent (de-accented) than it would be if spoken in isolation or in a phrase such as "The next word is . . . ". Consequently, in many cases improper prosodic treatment will lead to a misunderstanding of the meaning. For example a French teacher is a teacher of French; whereas a French teacher comes from France, and what is taught is undefined. Similarly steel warehouse is a warehouse made of steel, whereas steel warehouse is a warehouse for storing steel (these examples are from Liberman, 1979). This phenomenon abounds in names and addresses, including savings bank, hair salon, air force base, health center, Information services, tea company, and plumbing supply.

Boundaries around initials. Initials need to be spoken in such a way that listeners will not interpret them as part of their neighboring words. Cases of insufficient separation of initials occur for most commercial synthesizers. Examples that have been observed in several state-of-the-art commercial devices:

Terrance C McKay may sound like Terrance Seem OK (blended right, shifted word boundary)

Helen C Burns may sound like Helen Seaburns (blended right)

G and M may sound like G N M (misperceived)

C E Abrecht may sound like C Abrecht (blended left, then disappeared)

Treatment of "and". In some cases "and" only conjoins its immediately-adjacent words. Thus for example although there should be a prosodic boundary to the left of ". . . and . . . " in "George Smith and Mabel Jones", the boundary should be moved to the right of the word after the first "and" in "G and M Hardware and Supply". This is particularly true if the surrounding items are initials. For example "A and P Tea Company" may sound like "A, and P T Company", prosodically similar to "A, and P T Barnum".

Cliticized titles. Prepended titles, such as Mr, Mrs, Dr, etc., should be prosodically less salient than the subsequent words.

"Given" phone numbers. One of the most-studied phenomena in English prosody is the reduction in prosodic prominence of information that has previously been "given" in the dialogue, and the assignment of additional prominence to information that is "new" in the dialogue. If words which are "given" in their discourse context are spoken with a prosodic salience which implies they are "new", then listeners will (i) be more likely to misunderstand some of the subsequent speech, and/or (ii) require significantly longer to understand the whole utterance. In the preferred embodiment, the nature of the dialogue guarantees that the telephone number is "given". The caller has just typed it in, and the synthesizer echoes it back as the first part of the sentence containing the associated name. The main prosodic consequence of this discourse function is that it should be spoken more quickly than the subsequent material.

One exception is the case of auxiliary numbers. Here there are two phone numbers: the first which is "given" and the second which is "new". In this case the fast should be faster and less salient, but the second should be much slower and more salient.

Grouped letters while spelling. When humans spell names, they separate the string of letters into groups. Thus for example "Silverman" is often spelled out as "S-I-L, V-E-R, M-A-N". These groups are separated from each other by insertion of a slight pause, by lengthening of the last item in a group, and by concomitant pitch features indicating (i) a boundary is occurring, but (ii) there is more material coming in the current item. This phenomenon is most common, and most helpful, in longer names such as "Vaillancourt" or "Harrington". It reflects characteristics (and limits) of human speech production as well as human speech perception: it gives speakers opportunities to breath in more air (lungs have finite capacity), and it prevents an overflow of the listener's short-term acoustic memory. If a synthesizer does not do this while spelling a name, then (i) the speech sounds less pleasant and less natural—some listeners have described themselves as "running out of breath" while listening—and (ii) the listener is more likely to miss some letters and request one or more repetitions of the spelling.

Hierarchical boundaries while spelling. The protocol when callers request spelling is that each word is spoken, followed by its spelling. It is helpful to the listener if the synthesizer prosodically separates the speaking of one item from its spelling, and the end of its spelling from the beginning of speaking the next word. If the hierarchical organization of the spoken string is not clearly marked for the listener then at best listening is difficult and requires more concentration, at worst there will be misperceptions. Most often this occurs when there is an initial in the name. Example confusions that were induced in testing by the prior art synthesizers (employing their designed-in unrestricted text prosody rules) when spelling included:

For "Wendell M. Hollis":

Wendell W-E-N-D-E-L-L. Emhollis H-O-L-L-I-S. (missing boundary after the middle initial, made the surname sound prosodically like the word "emphatic")

For "Terrance C. McKay, Sr":

Terrance T-E-R-R-A-N-C-E-C McKay M-C-K-A Why Senior? (missing boundaries, combined with the boundaries between letters being stronger than the boundaries between the last letter of a word and the speaking of the next word, caused several misperceptions)

De-accenting repeated items. Many listings of telephone subscribers contain two people with the same family name, as in "Yvonne Vaillancourt care of J. Vaillancourt", and "Ralph Thompson and Mary Thompson". In these cases, the second instance of the family name should be de-accented, for similar reasons to those given above concerning the "given" (i.e., known to the user) phone numbers. If the second item does incorrectly contain an accent (as will be the case when the prosody is generated by typical rules designed for unrestricetd text), it sounds contrastive, as if the speaker is pointing out 19 the listener "this is not the same as the previous family name that you just heard". This is misleading and confusing: it causes the listener to backtrack and attempt to recover from an apparent misperception of the prior name. This backtracking and error-recovery only takes a moment, but can often be sufficient to cause the listener to lose track of the speech. This is particularly so when there is subsequent material still being spoken, Initialisms are not initials. The letters that make up acronyms or initialisms, such as in "IBM" or "EGL" should not be separated from each other the same way as initials, such as in "C E Abrecht". If this distinction is not properly produced by a synthesizer, then a multi-acronym name such as "ADP FIS" will be mistaken for one spelled word, rather than two distinct lexical items.

B. Selecting Rules for Prosody in Names and Addresses

Figure 3:
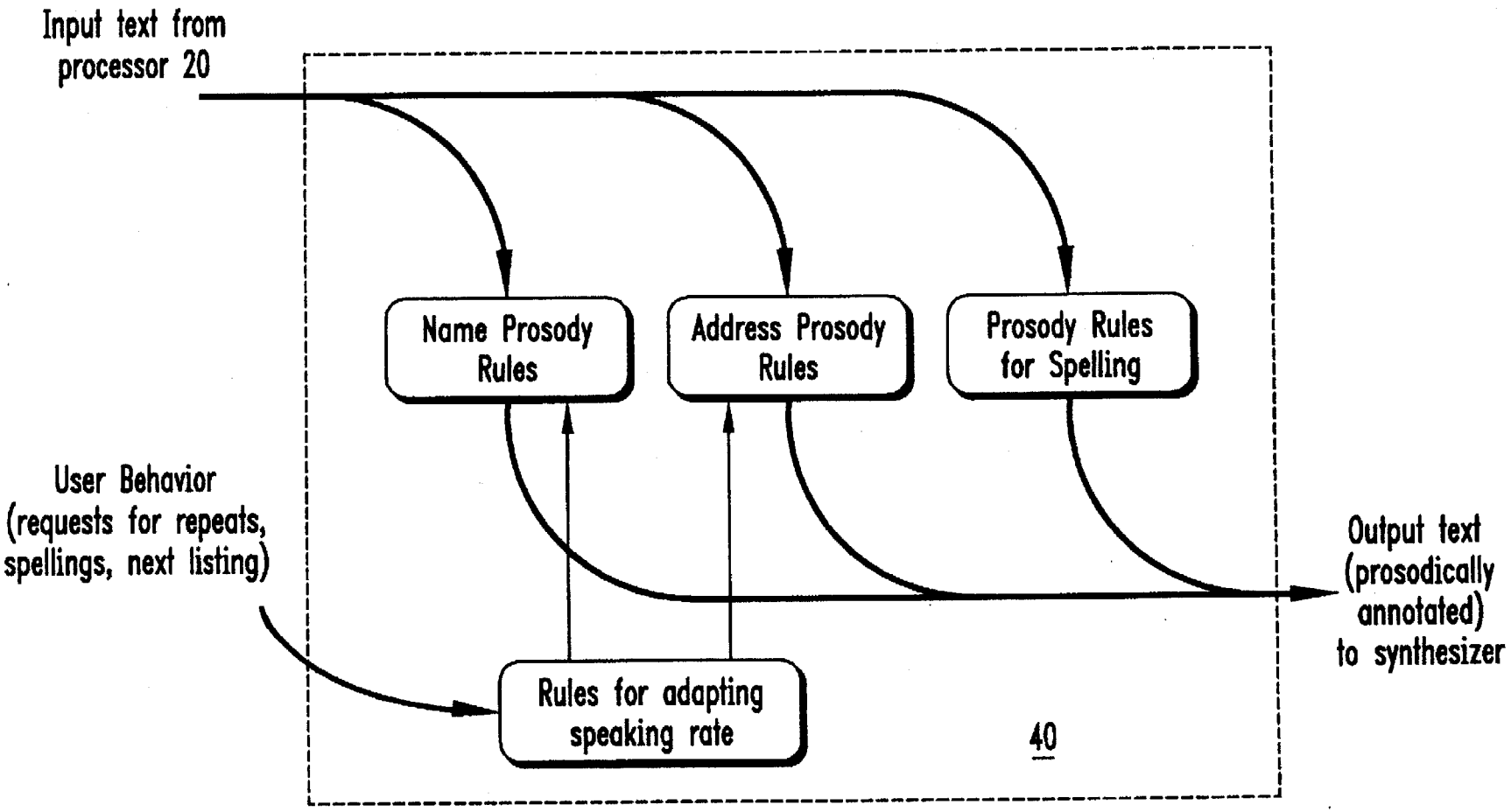
FIG. 3 shows the organization of the functionalities of the supplemental prosody processor of the preferred embodiment in the exemplary application.

Taking the above-described factors into account in implementation of the preferred embodiment, prosody preprocessor 40 was devised in accordance with the general organization of FIG. 3, i.e. it takes names and addresses as output by the text processor 20 in a field-organized form and corrected, and then preprocessor 40 embeds prosodic indicia or markers within that text to specify to the synthesizer the desired prosody according to the prosody rules. Those rules are elaborated below and are designed to replace, override or supplement the rules in the synthesizer 30. The preprocessing is thus accomplished by software containing analysis, instruction and command features in accordance with the context-free grammars of FIGS. 4 and 5 for the respective name and address fields. After passing through the preprocessor 40, the annotated text is then sent to speech synthesizer 30 for the generation of synthetic speech.

Ideally, the prosodic indicia that are embedded in the text by preprocessor 40 would specify exactly how the text is to be spoken by synthesizer 30. In reality, however, they specify at best an approximation because of limited instructional markers designed into the commercial synthesizers. Thus implementation needs to take into account the constraints due to the controls made available by that synthesizer. Some of the manipulations that are needed for this type of customization are not available, so they must be approximated as closely as possible. Moreover, some of the controls that are available interact in unpredictable and, at times, in mutually-detrimental ways. For the DECtalk unit, some non-conventional combination, or sequences of markers were employed because their undocumented side-effects were the best approximation that could be achieved for sonic phenomena. Use of the DECtalk unit in the preferred embodiment will be described in greater detail below.

More specifically, with the above constraints in mind, in the preferred embodiment, preprocessor 40's prosody rules were designed to implement the following criteria ( It will be appreciated that the rules themselves are to be discussed in greater detail after the following review of the criteria used in their formulation):

(i) global shaping of the prosody for each discourse turn. That turn might be one short sentence, as in "914 555 0303 shows no listing", or several sentences long, as in "The number 914 555 3030 is an auxiliary line. The main number is 914 555 3000. That number is handled by US Computations of East Minster, doing business as Southern New York Holdings Incorporated, in White Plains, N.Y., 10604". These turns are all prosodically grouped together by systematic variation of the overall pitch range, lowering the final endpoint, deaccenting items in compounds (e.g. "auxiliary line"), and placing accents correctly to indicate backward references (e.g. "That number . . . "). The phone number which is being echoed back to the listener, which the listener only keyed in a few seconds prior, is spoken rather quickly (the 914 555-3030. in this example). The one which is new is spoken more slowly, with larger prosodic boundaries after the area code and other group of digits, and an extra boundary between the eighth and ninth digits. This is the way experienced CNA operators usually speak this type of listing. Thus that text which is originally known to the listener is being spoken by the preferred embodiment explicitly to refer to the known text by speaking more quickly and with reduced salience.

Another component of the discourse-level influence on prosody is the prosody of carrier phrases. The selection and placement of pitch accents and boundaries in these were specified in the light of the discourse context, rather than being left to the default rules within the synthesizer.

One particular type of boundary that was included deserves special mention. This type of boundary occurs immediately before information-bearing words. For example, 555-3040 is listed to | Kim Silverman. At | 500 John Street. In | Eastminster These boundaries do not disrupt the speech the way a comma would. They serve to alert the listener that important material is about to be spoken, and thereby help guide the listener's attention. These boundaries consist of a short pause, with little or no lengthening of the preceding phonetic material and no preceding boundary-related pitch movements. Another way that they differ from other prosodic boundaries is that they do not separate intonational phrases.

Therefore, the words before them need not contain any pitch accents at all. Thus the "At" is not accented in the sentence At | 500 John Street (ii) signaling the internal structure of individual fields. The most complicated and extensive set of rules is for name fields. This makes sense because they exhibit significant variation, and are the component of names and addresses that is most frequently and universally needed across the whole field of automated information provision. In the preferred embodiment, name fields are the only field that is guaranteed to occur in every listing in the CNA service. Most listings spoken by the operators have only a name field. Rules for this field first need to identify word strings that have a structuring purpose (relationally marking text components) rather than being information-bearing in themselves, such as "... doing business as . . . "". . . in care of . . . "". . . attention . . . ". Their content is usually inferable. The relative pitch range is reduced, the speaking rate is increased, and the stress is lowered. These features jointly signal to the listener the role that these words play. In addition, the reduced range allows the synthesizer to use its normal and boosted range to mark the start of information-bearing units on either side of these conjunctions. These units themselves are either residential or business names, which are then analyzed for a number of structural features. Prefixed titles (Mr, Dr, etc.) are cliticized (assigned less salience so that they prosodically merge with the next word), unless they are head words in their own right (e.g. "Misses Incorporated"). As can be seen, a head is a textual segment remaining after removal of prefixed titles and accentable suffixes. Accentable suffixes (incorporated, the second, etc.) are separated from their preceding head by a prosodic boundary of their own. After these accentable suffixes are stripped off, the right hand edge of the head itself is searched for suffixes that indicate a complex nominal (complex nominals are text sequences, composed either of nouns or of adjectives and nouns, that function as one coherent noun phrase, and which may need their own prosodic treatment). If one of these complex nominals is found, its suffix has its pitch accent removed, to yield for example Building Company, Plumbing Supply, Health Services, and Savings Bank. These deaccentable suffixes can be defined in a table. However if the preceding word is a function word then they are NOT deaccented, to allow for constructs such as "John's Hardware and Supply", or "The Limited". The rest of the head is then searched for a prefix on the right, in the form of "<word> and <word>". If found, then this is put into its own intermediate phrase, which separates it from the following material for the listener. This causes constructs like "A and P Tea Company" to NOT sound like "A, and P T Company" (prosodically analogous to "A, and P T Barnum"). Context-free grammars for implementation of these rule features are shown in FIG. 4.

Within a head, words are prosodically separated from each other very slightly, to make the word boundaries clearer. The pitch contour at these separations is chosen to signal to the listener that although slight disjuncture is present, these words cohere together as a larger unit.

Similar principles are applied within the address fields. For example, a longer address starts with a higher pitch than a shorter one, deaccenting is performed to distinguish "Johnson Avenue" from "Johnson Street", ambiguities like "120 3rd Street" versus "100 23rd Street" versus "123rd Street" are detected and resolved with boundaries and pauses, and so on. In city fields, items like "Warren Air Force Base" have the accents removed from the fight hand, two words. An important component of signaling the internal structure of fields is to mark their boundaries. Rules concerning inter-field boundaries prevent listings like "Sylvia Rose in Baume Forest" from being misheard as "Sylvia Rosenbaum Forest". The boundary between a name field and its subsequent address field is further varied according to the length of the name field: The preferred embodiment pauses longer before an address after a long name than after a short one, to give the listener time to perform any necessary backtracking, ambiguity resolution, or lexical access. The grammars of FIG. 4 illustrate structural regularity or characteristics of address fields used to apply the prosodic treatment rules discussed in detail below.

In this approach, to generalize somewhat, the software essentially effects recognition of demarcation features (such as field boundaries, or punctuation in certain contexts, or certain word sequences like the inferable markers like "doing business as"), and implements prosody in the text both in the name field (and in the address field and spelling feature as well, as will be seen from the discussion below) according to the following method:

a) identifying major prosodic groupings by utilizing major demarcation features (like field boundaries) to define the beginning and end of the major prosodic groupings;

b) identifying prosodic subgroupings within the major prosodic groupings according to prosodic rules for analyzing the text for predetermined textual markers (like the inferable markers) indicative of prosodically isolatible subgroupings not delineated by the major demarcations dividing the prosodic major groupings, c) within the prosodic subgroupings, identifying prosodically separable subgroup components (by for example identifying textual indicators which mark relations of text groupings around them—as in A&P | Tea Co.—utilizing the textual indicators to separate the text within the prosodic subgrouping into units of nominal text which do not include the aforementioned predetermined textual markers, and within the units of nominal text, identify relational words that are not predetermined textual markers, nouns, and qualifiers of nouns) and d) generating prosody indicia which include pitch range signifiers utilizable by the synthesis device to vary the pitch of segments of the synthesized speech such that (i) the salience signifiers within the prosodic subgroupings are fast generated in accordance with predetermined salience rules solely relating to the components themselves.

(ii) modifying the salience signifiers to increase the salience at the start of the prosodic subgroup and decrease the salience at the end of the prosodic subgroup, and (iii) further modifying the salience signifiers to further increase the salience at the start of the major prosodic grouping and further decrease the salience at the end of the major prosodic grouping.

Figure 6:
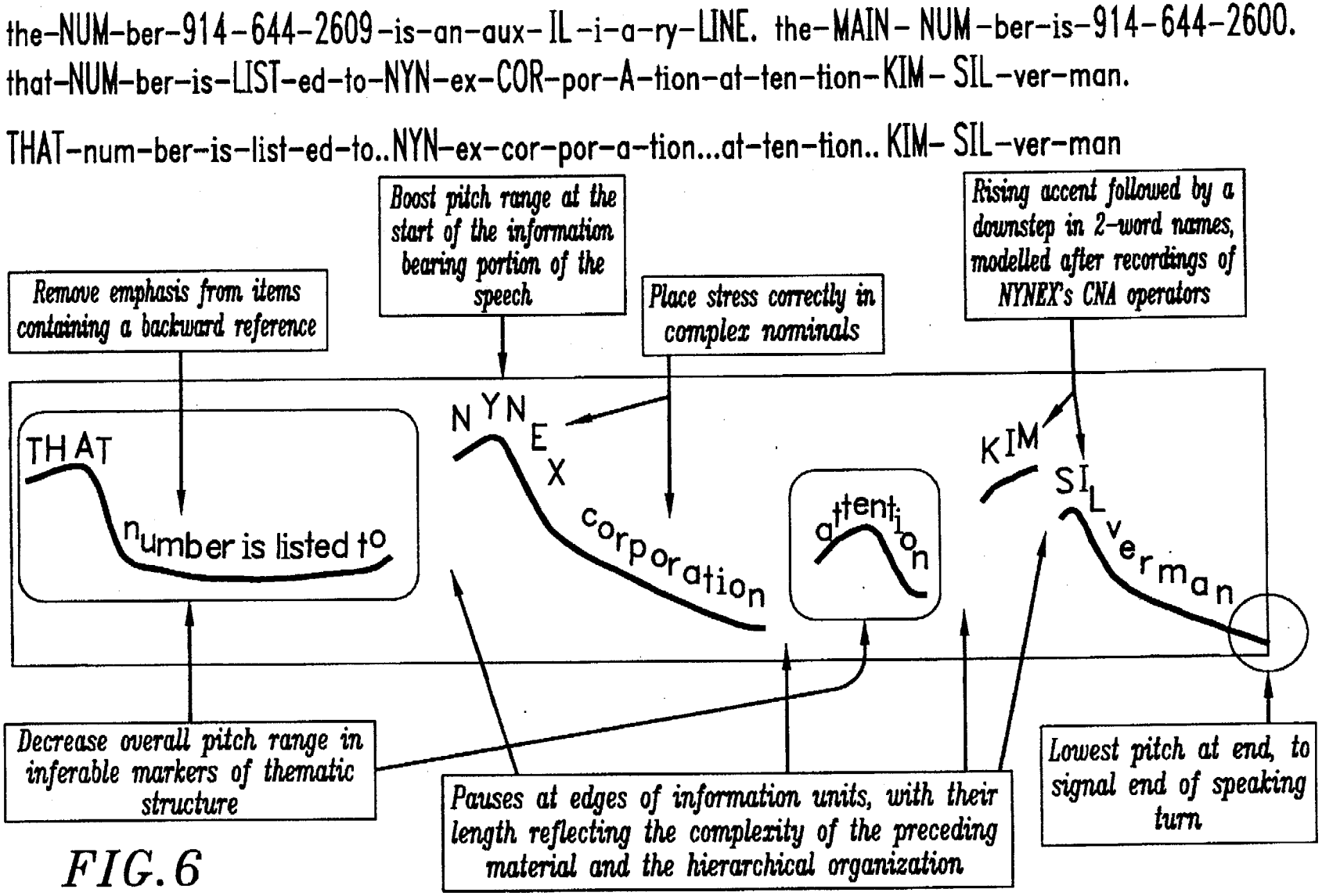
FIG. 6 shows the prosodic treatment accross a discourse turn in accordance with the prosodic rules of the preferred embodiment.

These groupings are prosodically determined entities and need not correspond to textual or to orthographic sentences, paragraphs and the like. A grouping, for example, may span multiple orthographic sentences, or a sentence may consist of a set of prosodic groupings. As will be appreciated, the adjustment of the pitch range at the boundaries of the groupings, subgroupings and major groupings is to increase or decrease, as the case may be, the prosodic salience of the synthesized text features in a manner which signifies the demarcation of the boundaries in a way that the result sounds like normal speech prosody for the particular dialog. As will also be understood, pitch adjustment is not the only way such boundaries can be indicated, since, for example, changes in pause duration act as boundary signifiers as well, and a combination of pitch change with pause duration change would be typical and is implemented to adjust salience for boundary demarcation. The effects of this method are illustrated in FIG. 6.

Such prosodic boundaries are pauses or other similar phenomena which speakers insert into their stream of speech: they break the speech up into subgroups of words, thoughts, phrases, or ideas. In typical text-to-speech systems there is a small repertoire of prosodic boundaries that can be specified by the user by embedding certain markers into the input text. Two boundaries that are available in virtually all synthesizers are those that correspond to a period and a comma, respectively. Both boundaries are accompanied by the insertion of a short period of silence and significant lengthening of the textual material immediately prior to the boundary. The period corresponds to the steep fall in pitch to the bottom of the speakers normal pitch range that occurs at the end of a neutral declarative sentence. The comma corresponds to a fall to near the bottom of the speakers range followed by a partial rise, as often occurs medially between two ideas or clauses within a single sentence. The period-related fall conveys a sense of finality, whereas the fall-rise conveys a sense of the end of a non-final idea, a sense that "more is coming".

In real human speech prosodic boundaries vary much more than is reflected in this two-way distinction. The dimensions along which they vary are tonal structure, amount of lengthening of the material immediately prior to the boundary, and the duration of the silence which is inserted. The tonal structure refers to whether and how much the pitch falls, rises, or stays level. Different tonal structures at a boundary in a sentence will convey different meanings, depending on the boundary tones and on the sentence itself. The amount of lengthening, and the amount of silence, both serve to make a prosodic boundary more or less salient.

The default prosody rules within many state-of-the-art commercial synthesizers will only insert a small number of different prosodic boundaries into their speech, based on a simplistic analysis of the input text. The controls that these synthesizers make available, however, give the user or system designer considerably more flexibility and control concerning the variation in prosodic boundaries. There are, however, few reliable guidelines to help that designer capitalize on that control. Indeed, if general principles for using these in unrestricted text were obvious and clear then the synthesizers' own default rules would implement them.

In the current work one way we capitalize on the constraints of the application is to exploit a rich variation of prosodic boundaries. In general we specify a somewhat wider variety of tonal characteristics at boundaries, and in particular we vary what we call the "size" or "strength" of the boundary. This refers to the salience of the boundary: a "larger" or "stronger" boundary is a more salient boundary: a boundary that is more noticeable to the listener. It conveys a sense of a more major division in the text or underlying information structure. The strength of boundaries is primarily manipulated in the exemplary application by insertion of more or less silence at the point of the disjuncture. Wherever the rules call for a "larger" boundary this boundary will have a longer duration of pause, "smaller boundaries" have less pause. The pause duration is specified in units relative to the current speaking rate, such that a large boundary at a very fast speaking rate may have a shorter absolute pause than a smaller boundary at a very slow speaking rate. Nevertheless within a given speaking rate the relative strength of boundaries generally correlates with the relative duration of the accompanying pause. In implementing prosodic boundaries when voice synthesis devices like DECtalk are used, silence phonemes are used for prosodic indicia. One silence phoneme may be a weak boundary two a stronger boundary and so on. In the preferred embodiment discussed, the strongest boundary is no greater than six silence phonemes. As will be understood, this is only one boundary aspect, and pitch variation and lengthening of the preceeding material feature as well in the implementation of the boundaries.

The main exception to this is the so-called information-cueing boundaries which are inserted between some carrier phrases and the immediately-following new information. Some of these are relatively long, but do not convey a sense of a major division to the listener. Rather they convey a sense of anticipation that something particular important or relevant is about to be spoken. This difference is achieved by having less lengthening of the material at the boundary, and little or none of the more commonly-used pitch movement prior to that boundary. The detailed implementation description includes specifications of these boundaries.

The idea that prosodic boundaries can vary in principle in their strength and pitch is not new. The contribution of the invention is to show a way to exploit this type of variation within a restricted text application in order to make the speech more understandable. The information-cueing pauses, however, have hardly been described in the literature and are not typical of text-to-speech synthesis rules.

In addition to these prosodic functions as shown in FIG. 3, the preferred embodiment contains additional functionalities addressing speaking rate and spelling implementations, thus:

(iii) adapting the speaking rate. Speaking rate is the rate at which the synthesizer announces the synthesized text, and is a powerful contributor to synthesizer intelligibility: it is possible to understand even an extremely poor synthesizer if it speaks slowly enough. But the slower it speaks, the more pathological it sounds. Synthetic speech often sounds "too fast", even though it is often slower than natural speech. Moreover, the more familiar a listener is with the synthesized speech, the faster the listener will want that speech to be. Consequently, it is unclear what the appropriate speaking rate should be for a particular synthesizer, since this depends on the characteristics of both the synthesizer and the application. In the preferred embodiment, this problem is addressed by automatically adjusting the speaking rate according to how well listeners understand the speech. The preferred embodiment provides a functionality for the preprocessor 40 that modifies the speaking rate from listing to listing on the basis of whether customers request repeats. Briefly, repeats of listings are presented faster than the first presentation, because listeners typically ask for a repeat in order to hear only one particular part of a listing. However if a listener consistently requests repeats for several consecutive listings, then the starting rate for new listings is slowed down. If this happens over sufficient consecutive calls, then the default starting rate for a new call is slowed down. If there are no requests for repeats for a predetermined number of successive listings within a call, then the speaking rate is incremented for subsequent listings in that call until a request for repeat occurs. New call speaking rate is initially set based on history of previous adjustments over multiple previous calls. This will be discussed in greater detail below. By modeling speaking rate at three different levels in this way, the synthesizer system of the preferred embodiment attempts to distinguish between a particularly difficult listing, a particularly confused listener, and an altogether-too-fast (or too slow) synthesizer. The algorithm in the preferred embodiment for controlling the speaking rate is presented in more detail below.

(iv) spelling. This functionality aids the way items are spelled, in two ways. Firstly, using the same prosodic principles and features as above, the preprocessor 40 causes variation in pitch range, boundary tones, and pause durations to define the end of the spelling of one item from the start of the next (to avoid "Terrance C McKay Sr." from being spelled "T-E-R-R-A-N-C-E-C, M-C-K-A Why Senior"), and it breaks long strings of letters into groups, so that "Silverman" is spelled "S-I-L, V-E-R, M-A-N". Secondly, it spells by analogy letters that are ambiguous over the telephone, such as "F for Frank". Moreover, it uses context-sensitive rules to decide when to do this, so that it is not done when the letter is predictable by the listener. Thus N is spelled "N for Nancy" in a name like "Nike", but not in a name like "Chang". In addition, the choice of analogy itself depends on the word, so that "David" is NOT spelled "D for David. A. . . . " The algorithm in the preferred embodiment dealing with spelling implementation is presented in more detail below as well.

All of the above-identified functionalities are implemented in software implementing the context-free grammars in the FIGS. 4 and FIG. 5 on preprocessor 40, that is, according to the following more specific rules:

1. Detailed Rules for the NAME Field

More specifically, in the following description of the preferred embodiment of FIG. 2 and FIG. 3, in the name field, rules a) to d) concern overall processing of the complete NAME field. Rules e) to q) refer to the processing of the internal structure of COMPONENT NAMES as defined in a) to d), below.

a) Within the name fields the software first looks for RELATIONAL MARKERS that divide the name field into two segments, where each segment is a name in its own right. These segments shall be called COMPONENT NAMES. For example, in the term "NYNEX Corporation doing business as S and T Incorporated", the string "NYNEX Corporation" and the string "S and T Incorporated" would each be a COMPONENT NAME. If no relational marker (here "d/b/a") occurred in the name field, then it is assumed to be and is treated as a single COMPONENT NAME. Typical relational markers include ". . . doing business as . . . ", ". . . care of . . . ", and ". . . attention: . . . ". The prosodic treatment applied to these relational markers is that they are (i) preceded and followed by a relatively long pause (longer than the pauses described in e).f).l).n).and p) below); (ii) spoken with less salience than the surrounding COMPONENT NAMES, conveyed by less stress, lowered overall pitch range, less amplitude, and whatever other correlates of prosodic salience can be controlled within the particular speech synthesizer being used in the application b) After the identification of any relational markers referred to in a) above, the COMPONENT NAMES are each processed according to their internal structure by the rules identified as e) to q), below.

c) The whole name field, whether it consists of a single COMPONENT NAME or multiple COMPONENT NAMES separated by RELATIONAL MARKERS, is treated as a single TOPIC GROUP. The consequent prosodic treatment is to (i) increase the overall pitch range at the start. (ii) decrease the pitch range gradually over the duration of the TOPIC GROUP (this can be done in stepwise decrements at particular points in the text (see U.S. Pat. No. 4,908,867), smoothly as a function of time, or in any other means controllable within the particular speech synthesizer being used in the application), and (iii) inserting an extra pause at the fight hand edge and (iv) optionally adjusting the duration of that pause according to the length, complexity, or phonetic confusibility of the TOPIC GROUP.

d) If a whole name field consists of more than one COMPONENT NAME, then each COMPONENT NAME (and its preceding RELATIONAL MARKER, if it is not the fast COMPONENT NAME in the name field) is treated prosodically as a declarative sentence. Specifically it ends with a low final pitch value. This is how a "sentence" will often be read aloud. In the example above, this would result in "NYNEX Corporation. Doing business as S and T Incorporated.", where the periods indicate low final pitch values. Rules e) to q) concern COMPONENT NAMES, and are to be applied in the sequence below; the COMPONENT NAME is seen to be treated as a single string of text operated on by preprocessor 40 according to those rules.

e) If there is a PREFIXED TITLE on the left hand edge, then this is removed and given appropriate prosodic treatment. PREFIXED TITLES are defined in a table, and include for example Mr, Dr, Reverend, Captain, and the like. The contents of this table are to be set according to the possible variety of names and addresses that can be expected within the particular application. The prosodic treatment these are given is to reduce the prosodic salience of the PREFIXED TITLE and introduce a small pause between it and the subsequent text. The salience is modified by alteration of the pitch, the amplitude and the speed of the pronunciation. After any text is detected and treated by this rule, it is removed from the string before application of the subsequent rules.

f) On the right hand edge of the remainder of the name field the software looks for separable accentable suffixes, for example, incorporated, junior, senior. II or III and the like. The prosody rules introduce a pause before such suffixes and emphasize the suffixes by pitch, duration, amplitude, and whatever other correlates of prosodic salience can be controlled within the particular speech synthesizer being used in the application. After any text is detected and treated by this rule, it is removed from the string before application of the subsequent rules.

g) On the right hand edge of the remainder of the name field the software seeks deaccentable suffixes. These are known words which, when occurring after other words, join with those preceding words to make a single conceptual unit. For example( with the deaccentable suffix in italics), "Building company", "Health center", "Hardware supply", "Excelsior limited", "NYNEX corporation". These words are defined in the application of the preferred embodiment in a table that is appropriate for the application (although it is conceivable that they may be determined from application of more general techniques to the text, such as rules or probabilistic methods). The prosodic treatment they receive is to greatly reduce their salience, but NOT separate them prosodically from the preceding material. However, if the word to the left is a functional word then the suffix is not be treated by this rule. For example, "Johnson's Hardware Supply" versus "Johnson's Hardware and Supply". The "and" is a functional word and the word "Supply" does not get de-emphasis. The general rule otherwise would be to de-emphasize the deaccentable suffixes. After any text is detected and treated by this rule, it is removed from the string before application of the subsequent rules.

h) If a particular suffix recognized by the application of the previous rules has no prior reference, that is to say, no preceding textual material, then it receives no special treatment and is not removed from the string. For example, "corporation" existing alone instead of "XYZ Corporation". In "XYZ Corporation", "Corporation" receives prosodic de-emphasis or deaccenting when pronounced by the synthesizer.

i) If a title exists with a deaccentable suffix but no other intervening material, then that suffix gets the accent back that would otherwise be removed by the previous rules. For example the "Company" in "Mr Company", the "limited" in "The Limited", or the "Sales" in "Captain Sales Incorporated".

j) If a title occurs with an accentable suffix, then the title is neither removed from the string nor given special prosodic treatment. It therefore survives to be treated as a NAME HEAD, defined below. For example "Mr Junior".

k) If a deaccentable suffix is followed by an accentable suffix but not preceded by anything, then that deaccentable suffix is neither removed from the string nor given special prosodic treatment. It therefore survives to be treated as a NAME NUCLEUS, defined below. For example, "Service, incorporated".

By way of background to what follows, a NAME HEAD can have some further internal structure: it always consists of at least a NAME NUCLEUS which specifies the entity referred to by the name (here "name" has its ordinary, colloquial meaning), usually in the most detail. In some cases, this NAME NUCLEUS is further modified by a prepended SUBSTANTIVE PREFIX to further uniquely identify the referent.

l) On the left hand edge of the remainder of the name field the software seeks a SUBSTANTIVE PREFIX. This is defined in two ways. Firstly a table of known such prefixes is defined for the particular application. In the exemplary CNA application this table contains entries such as "Commonwealth of Massachusetts", "New York Telephone", and "State of Maine". SUBSTANTIVE PREFIXES are strings which occur at the start of many name fields and describe an institution or entity which has many departments or other similar subcategories. These will often be large corporations, state departments, hospitals, and the like. If no SUBSTANTIVE PREFIX is found from the first definition, then a second is applied. This is single word, followed by "and", followed by another single word. This is considered to be a SUBSTANTIVE PREFIX if and only if there is further textual material following it after the application of rules f) and g) which stripped text from the right hand edge of the COMPONENT NAME. Examples would include the prefixes in "Standard and Poor Financial Planners". "A and P Tea Company", and "G and M Hardware and Supply Incorporated".

The prosodic treatment for a SUBSTANTIVE PREFIX found by either method is to separate it prosodically by a short pause, and a slight pitch rise, from the subsequent text.

After any text is detected and treated by this rule, it is removed from the string before application of the subsequent rules.

m) Any text remaining after the application of all the above rules is the most important denominating text in defining the COMPONENT NAME as a unique concept—this shall be identified as a NAME NUCLEUS. For example it is the UPPER CASE text in the following examples:

mr J E EDWARDSON junior

EDUCATION department new york state DEPARTMENT OF EDUCATION

NYNEX corporation

CORPORATION SECRETARIES limited n) If the NAME NUCLEUS is not preceded by a SUBSTANTIVE PREFIX and is a string of two or more words they are all separated from each other by a very slight pause, and a predetermined clear and deliberate-sounding pitch contour pattern depending on the number of words is employed. For example, the fast word is given a local maximum falling to low in the speakers range. This rule is imposed when we have no better idea of the internal structure based upon the application of previous rules.

o) A longer pause than would otherwise be provided by rule j) is inserted after each initial in the NAME NUCLEUS. For example, James P. Rally If a word is a function word (defined in a table) then it is preceded by a longer pause and followed by a weak prosodic boundary.

p) If two surnames occur in a nucleus than the second is deaccented in the same way as DECCANTABLE SUFFIXES in rule g) above. This deals with name fields such as John Smith and Mary Smith Jones John and Mary Jones Georgina Brown Elizabeth Brown This is achieved by checking the rightmost word in the NAME NUCLEUS against all prior words in it. If that word is found in a prior position, but not immediately prior, then it is deaccented.

q) Treatment for any initial in a NAME NUCLEUS is to announce its letter status, such as "the letter J" or "initial B", if that letter is confusable with a name according to a look-up table. For example "J" can be confused with the name "Jay": the letter "b" can also be understood as the name "Bea".

2. Detailed Rules for the Address Field

Now, with respect to the address field prosody in the preferred embodiment, the basic approach is to find the two or three prosodic groupings selected through identification of major prosodic boundaries between groups according to an internal analysis described below.

The address field prosody rules in the preferred embodiment concern how address fields are processed for prosody in the preferred embodiment. Different treatment is given to the street address, the city, the state, and the zip code. The text fields are identified as being one of these four types before they are input to the prosody rules. Rules for the street address are the most complicated.

2.1 Street addresses 2.1.1) Each street address is first divided into one or more ADDRESS COMPONENTS, by the presence of any embedded commas (previously embedded in the text database). Each ADDRESS COMPONENT is then processed independently in the same way. An example street address with one component would be:

500 WESTCHESTER AVENUE

Examples with multiple components would be:

PO BOX 735E, ROUTE 45 or BUILDING 5, FLOOR 3, 43–58 PARK STREET 2.1.2) The processing of an ADDRESS COMPONENT begins by parsing it to identify whether it falls into one of three categories. The fast category is called a POST OFFICE BOX, the second a REGULAR STREET ADDRESS, and the third is OTHER COMPONENT. If the address does not match the grammars of either of the first two categories, then it will be treated by default as a member of the third. The context-free grammars for the first two categories are shown in FIG. 5, illustrating the context-free grammars for the address field.

2.1.3) If the ADDRESS COMPONENT is a POST OFFICE BOX, then the word "post" is given the most stress or prosodic salience, "office" is given the least, and "box" is given an intermediate level. These three words are separated into an intermediate phrase by themselves, and a short silence is inserted on the right hand edge.

2.1.4) The prosody for the alphanumeric string that follows "post office box" is left to the default rules built into the commercial synthesizer.

2.1.5) If the ADDRESS COMPONENT is a REGULAR STREET ADDRESS, then the first word is examined. If it only consists of digits, then a prosodic boundary will be inserted in its fight hand edge. The strength of that boundary will depend on the following word (that is to say the second word in the string).

2.1.5.1) If the second word is a normal word, then a medium-sized boundary is inserted, similar to that placed between a SUBSTANTIVE PREFIX and a NAME NUCLEUS in a NAME FIELD. (Note: In this context, a "normal word" is any word with no digits or imbedded punctuation, i.e., it is alphabetic only. However, the term "word" is thus seen to include a mixture of any printable nonblank characters)

2.1.5.2) If the following word is an ordinal (that is a digit string followed by letter indicating it is an ordinal value, such as 21ST, 423RD, or 4TH) then a more salient boundary, with a longer pause, is inserted. This helps separate the items for the listener, distinguishing cases like "1290 4TH AVENUE" from "1294TH AVENUE".

2.1.5.3) In all other cases a less salient boundary is inserted, similiar to what is used to separate items within a NAME NUCLEUS.

2.1.6) If the first word of a REGULAR STREET ADDRESS is either an ordinal or purely alphabetic, then it the street address consists of a street name with no prepended building number. No extra prosodic boundary is inserted between the first and second words.

2.1.7) If the first word of a REGULAR STREET ADDRESS is an apartment number (such as #10-3 or 4A), a complex building number (such as 31–39), or any other string of digits with either letters or punctuation characters, then its treatment depends on the second word.

2.1.7.1) If the second word is a digit string then the first word is considered to be a within-site identifier and the second word is considered to be the building number (as in #10–3 40 SMITH STREET). A large boundary is inserted between the first and second words, and a small boundary is inserted after the second.

2.1.7.2) If the second word is an ordinal (as in 10-3 40TH STREET), then a large boundary is still inserted after the first word but no extra boundary is inserted after the second.

2.1.7.3) If the second word is purely alphabetic (as in 10–13 SMITH STREET) then a medium-sized boundary is inserted between the first and second words.

2.1.7.4) In all other cases a small boundary is inserted after the first word.

2.1.8) After the first word or two of a REGULAR STREET ADDRESS are processed according to rules in 2.1.7 above, the rest of the text string is a THOROUGHFARE NAME. If the last word is "street", then it is deaccented in the same way as deaccentable suffixes on the right hand edge of a NAME NUCLEUS. Apart from this exception, the words of the text string are separated from each other and their pitch contours are varied according to the same algorithm as is used for a multi-word NAME NUCLEUS.

2.1.9) If the ADDRESS COMPONENT is neither a POST OFFICE nor a REGULAR STREET ADDRESS then it is considered to be an OTHER COMPONENT. This would be, for example, "Building 5" or "CORNER SMITH AND WEST". The prosodic treatment for the whole ADDRESS COMPONENT is in this case the same as for a multi-word NAME NUCLEUS.

2.1.10) After each non final ADDRESS COMPONENT in the street address a rather salient prosodic boundary is introduced that is similar to the one used between a NAME NUCLEUS and its following separable accentable suffix.

2.2 City Names

In the preferred embodiment, the field that is labelled "city name" will contain a level of description in the address that is between the street and the state. The prosody for most city names can be handled by the default rules of a commercial synthesizer. However there are particular subsets that require special treatment. The most common is air force bases, such as

WARREN AIR FORCE BASE

GRIFFISS AIR FORCE BASE

ROME AIR FORCE BASE

In all cases of this class, the words "FORCE BASE" are both deaccented in the same way as deaccentable suffices in name fields, 2.3 Overall prosodic treatment of addresses.

After the various address fields are treated according to the rules in 2.1 and 2.2, they are prosodically integrated into the overall discourse turn in the following way.

2.3.1) A pause is introduced between the preceding name field and the start of the address fields.

2.3.1.1) If there is a nonblank street address, then the duration of the pause is varied according to the complexity of the preceding name field. The complexity can be measured in a number of different ways, such as the total number of characters, the number of COMPONENT NAMES, the frequency or familiarity of the name, or the phonetic uniqueness of the name. In the preferred embodiment, the measure is the number of words (where an initial is counted as a word) across the whole name field. The more words there are, the longer the pause. The pause length is specified in the synthesizer's silence phoneme units whose duration is itself a function of the overall speaking rate, such that there is a longer silence in slower rates of speech. The pause length is not a linear function of the number of words in the preceding name field, but rather increases more slowly as the total length of the name field increases. Empirically predefined minimum and maximum pause durations may be imposed.

2.3.1.2) If the street address is blank then the duration of the pause is fixed and is equivalent to the minimum duration in 2.3.1.1.

2.3.2) If the street address is nonblank, then:

2.3.2.1) The overall pitch range is boosted to signal to the listener the start of a major new item of information. The range is then allowed to return to normal across the duration of the subsequent street address.

2.3.2.2) The word "at" is inserted before the street address, and is followed by an information-introducing boundary as discussed earlier in this document.

2.3.2.3) The text from the "at" till the end of the street address is treated as a single declarative sentence, by ending it with a low final pitch target (in the field of prosodic phonology this would be labeled as a Low Phrase Accent followed by a Low Final Boundary Tone).

2.3.3) If the city name or state are nonblank then:

2.3.3.1) The word "in" is prefixed, and is followed by an information-introducing boundary as discussed earlier in this document;

2.3.3.2) If there was both a city name AND a state, then they are separated by the same type of boundary that is used between items within a multi-word NAME NUCLEUS.

2.3.3.3) The text from the "in" till the end of the two fields is combined prosodically into one single declarative sentence, as in 2.3.2.3 above.

2.3.4) If there is a zip code, then it too is spoken as a single declarative sentence.

3. Spelling Rules

Furthermore, the embodiment of the illustrated specific name and address application also involves setting rules for spelling of words or terms. This, of course, may be done at the request of the user, although automatic institution of spelling may be useful. When text is to be spelled, it is handled by a module whose algorithm is described in this section. The output is a further text string to be sent to the synthesizer that will cause that synthesizer to say each word and then (if spelling was specified) to spell it. The module inserts commands to the synthesizer that specify how each word is to be spelled, and the concomitant prosody for the words and their spellings.

3.1 General description

The input to the spelling software module illustrated in FIG. 3 consists of a text string containing one or more words, and an associated data structure which indicates, for each word, whether or not that word is to be spelled. Thus for instance in a name field such as

JOHNSTON AND RILEY INCORPORATED it will not be necessary to spell either the AND or the INCORPORATED, and consequently these words would be marked as such.

3.2 Detailed rules 3.2.1) The whole multi-word string will be treated as one large prosodic paragraph, even though there will be groupings of multiple sentences within it. The overall pitch range at the start of the paragraph is raised, and then lowered over the duration of that paragraph. At the end the pitch range is lowered and the the low final endpoint at the end of the last sentence within it is caused to be lower than the low final endpoints in other nonfinal sentences within that paragraph.

3.2.2) Each word is spoken as a single-word declarative sentence, and if it is to be spelled then the spelling that follows it is also spoken as a declarative sentence.

3.2.3) If a word is to be spelled, then the prosodic sentence which is the saying of that word, and the subsequent prosodic sentence which is the spelling of that word, are combined into a larger prosodic group. The overall pitch range at the start this two-sentence group is raised and allowed to gradually return to its normal value over the come of the two sentences. If the word is not to be spelled, then its starting overall pitch range is not raised in this way.

The following rules concern the spelling of a word:

3.2.4) Each letter in a to-be-spelled word is categorized as to whether or not it is to be analogized, that is to say spelled by analogy with another word, as in "F for frank". This is a three-stage process:

3.2.4.1) There is a table of which letters should be analogized. The contents of this table are determined by determining, on the basis of considerations of the transmission medium and acoustic analyses of the spectral properties of the phonetics of the letter, which letters will be confusible with each other when spoken over this transmission medium. In the exemplary application the transmission characteristics under consideration were:

a) the upper limit of the acoustic spectrum is considered to be 3300 Hz. All information above this is considered unusable.

b) the signal-to-noise ratio is considered to be 25 Hz, with pink or white noise filling in the spectral valleys. This, combined with a), can make: all voiceless fricatives confusable: all voiced fricatives confusable; all voiceless stops confusable: all voiced stops confusable; and all nasals confusable.

c) Short silences or noise bursts can be added to the signal by the telephone network, thereby sounding like consonants. This can make voiceless and voiced cognates of stops mutually confusable by either masking aspiration in a voiceless stop, or inserting noise that sounds like it. In conjunction with b), it can make stops and fricatives with the same place of articulation confusable.

The words which are used for the analogies are chosen to fulfill three criteria:

3.2.4.1.1) They should make an allowable word for one and only one of the confusable letters. Thus, for example, "toy" would not be used as the analogy for "T", because "T for toy" could sound like "C for coy".

3.2.4.1.2) They should not be monosyllabic, so that the analogy word itself is less likely to be masked by transient signals of the type in c). If they are monosyllabic, then they should be long and predominantly voiced syllables.

3.2.4.2) If a letter is a candidate for analogy according to 3.2.4.1, then its left and fight context are examined. Rules for each letter in the table of 3.2.4.1 specify contexts in which that letter is NOT to be analogized. These rules turn off spelling by analogy in those contexts where the letter is largely predictable and where it is virtually impossible for one of the potentially confusable letters to occur. Thus for example, N would be spelled "N for Nancy" in a name such as "Nike", but not in a name like "Chang". Similarly it would not be necessary to anaolgize "S" in a name like "Smith", because "S" is confusable with "F" but "Fmith" would not be a possible name in English. In the preferred embodiment, the context examined by these rules is the immediately-preceding and immediately-following letter. The rules specify, for every, analogizable letter, combinations of preceding and following contexts. A word boundary is included as a possible specifiable context.

3.2.4.3) If a letter chosen by 3.2.4.1 is to be analogized and survives 3.2.4.3, then the word in which the letter occurs is examined. If that word happens to be the same as the intended analogy, then a second choice is used for that analogy. Thus for example "Donald" would begin with "D for David", but "David" would begin with "D for Doctor".

3.2.4.4) If a letter is to be analogized, and it is not the last letter in its word, then after the phrase consisting of that letter, "for", and the analogy, a nonfinal prosodic boundary with a short pause is inserted.

3.2.5) For strings of letters that are not to be analogized, these are prosodically divided into groups, hereafter referred to as "letter groupings", with a short pause inserted between the letter groupings. In the preferred embodiment this grouping is based on the number of letters in the string:

3.2.5.1) strings of up to 3 letters are left as a single chunk 3.2.5.2) 4 letters become two letter groupings of 2 letters each 3.2.5.3) 5 become two letter groupings: 2 letters then 3 letters 3.2.5.4) For more than 5 letters: separate them into letter groupings of 3 with, if necessary, the last one or two having 4 letters. For example:

6→3,3

7→3,4

8→4,4

9→3,3,3

10→3,3,4

3.2.6) If there is a to-be-analogized letter after a string of not-to-be-analogized letters, then a pause is inserted after the last chunk, that pause is longer than the pause placed between letter groupings in 3.2.5

3.2.7) The pause in 3.2.6 is shorter than the pause after analogized letters in 3.2.4.3.

In addition to the above rules, some variants are also possible:

3.2.8) If a word has a length of one letter, which is to say it is an initial (as in the middle word of "John F Kennedy") then it will be analogized regardless of its identity. It need not be in the table specified in 3.2.4.1 above.

3.2.9) If the same letter appears twice in a row, then instead of saying it twice, it can be preceded by the word "double" For example "Billy. B, I, double-L, Y", rather than "B, I, L, L, Y"

3.2.10) If a double letter is to be analogized, then precede that pair with "double" then analogized it once. Thus "Fanny. F, A, double-N for Nancy, Y", rather than "F, A, N for Nancy, N for Nancy, Y"

3.2.11) Common sequences of letters with special pronunciation are analogized as a group, by a word beginning with the same group. Hence for example "Thomas. TH for thingamajig, O, M, A, S"

3.2.12) Don't analogize analogizable letters if they occur in common sequences or common words. For example, don't analogize the "N" in "John".

4. Speech Rate Adjustment

One additional feature important for prosodic treatment of the fields being synthesized is the speech rate. The state of the an for unrestricted text synthesis is that when a synthesizer is built into an information-provision application a fixed speaking rate is set based on the designer's preference. Either this tends to be too fast because the designer may be too familiar with the system or set for the lowest common denominator and is too slow. Whatever it is set at, this will be less appropriate for some users than for others, depending on the complexity and predictability of the information being spoken, the familiarity of the user with the synthetic voice, and the signal quality of the transmission medium. Moreover the optimal rate for a particular population of users is likely to change over time as that population becomes more familiar with the system.

To address these problems, in the present invention and in the preferred embodiment being discussed, an adaptive rate is employed using the synthesizer's rate controls. In that CNA system, a user can ask for one or more name and address listings per call. Each listing can be repeated in response to a caller's request via DTMF signals on the touch tone phone. These repeats, or, as will be seen, the lack of them, are used to adapt the speech rate of the synthesizer at three different levels: within a listing; across listings within a call, and across calls. The general approach is to slow down the speaking rate if listeners keep asking for repeats. In order to stop the speaking rate from simply getting slower and slower ad infinitum, a second component of the approach is to speed up the speaking rate if listeners consistently do NOT request repeats. The combined effect of these two opposing effects (slowing down and speeding up) is that over sufficient time the speaking rate will approach, or converge on, and then gradually oscillate around an optimal value. This value will automatically increase as the listener population becomes more familiar with the speech, or if on the other hand there is a pervasive change in the constituency of the listener population such that the population in general becomes LESS experienced with synthesis and consequently request more repeats, then the optimal rate will automatically readjust itself to being slower.

4.1 Rate control within a listing.

Under the rules used in the preferred embodiment, if a caller requests a repeat then the rate of speech of the synthesizer will be adjusted before the material is spoken.

4.1.2) Two different parameters control this adjustment. One is the number of times a listing should be repeated before the rate is adjusted. For example if this parameter has the value of 2, then the first and second repeats will be presented at the same rate as the first time the text was spoken but the third repeat (if it is requested) will be at a different rate. This rule continues to apply across s subsequent repeats. In the exemplary CNA application this has a value of 1 and was set empirically, based on trial experience with the system.

4.1.2) The second parameter is the mount by which the rate should be changed. If this has a positive value, then the repeats will be spoken at a faster rate, and if it is negative then the repeats will be slower. The magnitude of this value controls how much the rate will be increased or decreased at each step. In the exemplary CNA application the adjustment is in the direction to make repeats faster.

4.2 Rate control across listings for a particular caller.

If a caller asks for sufficient repeats of a listing to cause its rate to be adjusted, then the initial presentation of the next listing for that caller will not necessarily be any different from the initial presentation of the current listing. The general principle is to assume that if a listener asked for multiple repeats of any listing then that was only due to some intrinsic difficulty of that particular listing: this will not necessarily mean that the listener will have similar difficulty with subsequent listings. Only if the listener consistently asks for multiple repeats of several consecutive listings is there sufficient evidence that the listener is having more general difficulty understanding the speech independently of what is being said. In that case the next listing will indeed be presented with a slower initial rate.

4.2.1) The rule for this is controlled by several parameters. One determines how many listings in a row should be repeated sufficiently often to have their speed adjusted, before the initial speaking rate of the next listing should be slower than in prior listings. A reasonable value is 2 listings, again set empirically, although this can be fine-tuned to be larger or smaller depending on the distribution of the number of listings requested per call.

4.2.2) A related parameter concerns the possibility that many listings in a row within a call might have repeats requested, but none of them have sufficient repeats to change their own speaking rate according to rule 4.1. In this case the caller seems to be having slight but consistent difficulty, which is still therefore considered sufficient evidence that the speaking rate for subsequent listings should be slower. A typical value for this parameter in the preferred embodiment is 3, once more, set empirically. In general it should be larger than the value of the parameter in 4.2.1

4.2.3) If the listener does NOT request repeats for a number of listings in a row, then it is assumed that the speaking rate is slow enough or even slower than it need be. In this case the initial rate of the subsequent listing should be increased. This is controlled in a similar way to 4.2.1. An empirically predetermined parameter determines how many listings in a row should be NOT repeated before the next listing is spoken faster. A typical value for this parameter in the preferred embodiment is 3.

4.2.4) Of course a third parameter determines how much the speaking rate should be changed down across listings when called for by rules 4.2.1, 4.2.2 or 4.2.3. It is recommended that this be no larger than the parameter in 4.1.2

In rules 4.2.2, 4.2.3 and 4.2.4, the discussed parameters are chosen to ensure that the rate does not diverge from the optimum.

4.3 Rate control across calls

The assumption in the rules in 4.2 is that if a listener keeps asking for repeats, then this only reflects that that particular listener is having difficulty understanding the speech, not that the synthesis, in general is too fast. However a set of rules also monitor the behavior of multiple users of the synthesis in order to respond to more general patterns of behavior. The measurement that these rules make is a comparison of the initial presentation rates of the first listing and last listing in each call. If the last listing in a call is presented at a faster initial rate than the first listing in that call then that call is characterized by the rules as being a SPEEDED call. Conversely if the initial rate of the last listing in a call is slower than the initial rate of the first listing, then that call is characterized as being a SLOWED call.

With these classifications, these rules look for consistent patterns across multiple calls, and respond to them by modifying the initial rate of the first listing in the next call.

4.3.1 One parameter determines how many calls in row need to be SLOWED before the default initial rate for the first listing in the next call is decreased.

4.3.2) A similar parameter determines how many calls in row need to be SPEEDED before the default initial rate for the first listing in the next call is increased.

4.3.3) A third parameter determines the magnitude of the adjustments in 4.3.1 and 4.3.2. This should not be larger than the parameter in 4.2.4.

4.4 Initial and boundary conditions.

The rate adaptation is initialized by setting a default rate for the initial presentation of the first listing for the first caller. Thereafter the above rules will vary the rates at the three different levels, as has been discussed. In the preferred embodiment this initial default rate was set to being a little slower than the manufacturer's factory-set default speaking rate for that particular device. (The manufacturer's default is 180 words per minute; the initial value in the preferred embodiment was 170 words per minute).

The rules in 4.1, 4.2 and 4.3 above cannot alter the rate past empirically predetermined absolute maximum and minimum values.

4.5 Two different relative speaking rates.

Finally, new and old material in an announcement get different rates. For example, if in addition to the text fields read by the synthesizer particular surrounding material that involves a repeat to aid the listener such as. "the number you requested 555 2121 is listed to Kim Silverman at 500 Westchester Avenue, White Plains, N.Y.", the initial phrase "the number you requested" is called a carrier phrase and gets a "carrier rate".

That is, it gets a rate faster than the surrounding material which is considered to be new information and therefore slower, i.e. this is called the master rate given to the new material. One parameter sets the difference between the carrier rate and the master rate. In the preferred embodiment it was determined empirically that it should have a value of 40.

This difference is maintained throughout the rate variation described above, except that neither the carrier rate nor the master rate may exceed the maximum and minimum values defined in 4.4. The rules in 4.1, 4.2 and 4.3 all control the master rate, and after each adjustment the carrier rate is recalculated.

C. Special Considerations for Use of DECtalk

As has been previously mentioned, not all desired prosodic treatments are necessarily directly available from the set of available instructions for particular synthesizer devices now on the market. DECtalk is no exception, and substitute or improvisational commands have to be employed to achieve the intended results of the preferred embodiment. For the DECtalk unit, some non-conventional combinations or sequences of markers were employed because their undocumented side-effects were the best approximation that could be achieved for some phenomena. For example there are places where the unit's rules want to increase the overall pitch range in the speech. There is a marker. [[+]], which is meant to be used to increase the starting pitch of sentences spoken by the synthesizer, and is recommended in the manual for the first sentence in a paragraph. However this only increases pitch by a barely-perceptible amount. There is however a different way to increase the overall range of fundamental frequency contours in the synthesizer that is almost limitless in its extent: by embedding a parameter specification that increases the standard deviation of fundamental frequency values for all subsequent speech. But this also turns out to be incorrect because it increases the range relative to the average pitch: thus the peaks get higher (which is what is needed) but at the expense of the low fundamental frequency values getting lower. When native speakers of English increase their pitch range for communicative speech purposes (as opposed to singing), they only increase the heights of their accent peaks. Their low values are largely unchanged. This parameter in the synthesizer unfortunately has a consequence of making the low values of pitch come out lower than is possible from a human larynx. The effect sounds too unnatural to be of any use.

There is a marker, [["]], which can be added before a word to give that word so-called "emphatic" stress. Although this is a misleading way to think about prosody, this marker causes the next word to bear an unusually-high and very late pitch peak. The height conveys an impression of salience, the temporal delay conveys an impression of surprise, disbelief, and incredulity. These impressions are exactly NOT the right way to say name and address information in the discourse context of an information service (imagine an operator saying "that number is listed to Kim Silverman, at '500?!?!' Westchester Avenue"), and it sounds distractingly childlike and unnatural if used on this material. However it turns out that a side-effect of this marker is that the pitch contour takes about half a second to drift back down over the subsequent words. With this behavior, it was possible to capitalize on that side-effect. Specifically, if the word that immediately follows the emphasis marker is spelled phonetically, and the only phoneme it contains is a "silence" phoneme, then the major and undesirable part of the pitch excursion is located on the silence and so is not audible. The subsequent words still carry the raised pitch, and so sound somewhat like they are spoken in a raised range. But the drawbacks of using this trick to boost pitch range include (i) it forces a silent pause to be inserted in what is often the wrong place in the speech, (ii) it causes the pitch contour to the left of the marker to also be modified, in a variable and unnatural way, (iii) the pitch accents in the subsequent boosted-range words have phonetically less-than-natural pitch contours, and (iv) the behavior of subsequent prosodic markers is sometimes broken by the presence of this sequence. Nevertheless this is the best way pitch range could be boosted in this synthesizer's speech.

The above technique to control pitch range is one of the more extreme examples of manipulating the prosody markers in a way not obvious from the manufacturer-supplied user documentation for the DECtalk unit, and requires some improvisation or substitution of commands to realize the prosodic effects intended for the preferred embodiment. The following section further describes other uses of symbols that were the result of similar substitution or improvisation.

Carrier phrases

In the preferred embodiment, the name and address information is embedded in short additional pieces of text to make complete sentences, in order to aid comprehension and avoid cryptic or obscure output. For example the information retrieved from the database for a particular listing might be "5551020 Kim Silverman". This would then be embedded in __ is listed to __ such that it would be spoken to the user as 555 1020 is listed to Kim Silverman This is a common technique-in information-provision applications, and so is a general phenomenon rather than a particular detail that is only relevant to the preferred embodiment. The current invention concerns the prosody that is applied to these "carrier phrases". The general principle motivating their treatment is that the default prosody rules that are designed into a commercial speech synthesizer are intended for unrestricted text and may not generate optimal prosody for the carrier phrases in the context of a particular information-provision application. The following discusses those customizations in the preferred embodiment that would not be obvious from combining well-known aspects of prosodic theory with the manufacturer-supplied documentation. Each of the following gives a particular carrier phrase as an example. This is not an exhaustive list of the carrier phrases used in the preferred embodiment, but it does show all relevant prosodic phenomena.

Some carrier phrases contain complex nominals that need special prosodic treatment.

Consider, for example, the following message:

The number 914 555 1020 is an auxiliary line. The main number is 914 555 1000. That number is handled by Rippemoff and Runn, Incorporated. For listing information please call 914 555 1987, (herein, "message 1"). In this message the carrier phrases include two such complex nominals: auxiliary line and listing information. In each case we wish to override the rules in the commercial synthesizer that would place a pitch accent on every word. Specifically we wish to remove the pitch accents from line and information. According to the manual for the device, this is usually to be achieved by either 1) inserting a hyphen between the relevant words (e.g. auxiliary-line), 2) replacing the orthography with phonetic transcriptions of the two words, and placing a pound sign ("*") between them, as in

[[s'ayd#'eyk]] for "sideache"

[[p'uhsh#'owvrr]] for "pushover"

3) replacing the orthography with phonetic transcriptions of the two words, and placing an asterisk ("*") between them, as in

[[mixs*sp'ehlixnx]] for "misspelling"

No a priori principle was found for predicting which of these above approaches, if any, would sound acceptable for any given complex nominal in any given sentence.. In the case of listing information, the hyphen was found to work best. But in the case of auxiliary line, all of the documented approaches were unsatisfactory. Specifically, they caused the pitch to fall too low and the duration of the word "line" to sound too short. The solution adopted was to encode the second word phonetically, but with (i) only a secondary stress rather than a primary stress on, its strongest syllable, and with (ii) a space, rather than a pound sign or an asterisk, separating it from its preceding word. Thus, for example, auxiliary [[l'ayn]]. This technique was also used for all of the deaccented suffixes in name fields, and for "post office box".

Function Words.

Some carrier phrases contain function words which, within their sentence and discourse context, need to be accented. The default prosody rules for the synthesis device do not place accents on function words. We shall show two examples. The first is in the carrier phrase:

The number 555 3545 is not published.

In this sentence, the default rules do not place any accent on "not". This causes to be produced with a low pitch and short duration. When spoken according to those rules, the sentence sounds like the speaker is focusing on "published" as if contrasting it with something else, as in "the number 555 3545 is not published, but rather it is only available under a strict licensing agreement." The solution was simply to spell this word phonetically, explicitly indicating that it should receive primary stress and a pitch accent:

. . . is [[n'aat]] published

The second example concerns the string "that number" in the longer example given earlier above (message 1). Within its particular sentence context, the expression "that number" is diectic. Since it is referring to an immediately-preceding item, that referred-to item ("number") needs no accent but the "that" does need one. Unfortunately DECtalk's inbuilt prosody rules do not place an accent on the word "that", because it is a function word. Therefore we have to hide from those rules the fact that "that" is "that". In this case the asterisk was the best way this could be achieved, even it does not sound ideal. Thus:

[[dh'aet*nahtnbrr]] is [[n'aat]] published.

In message 1, there is a similar need to deaccent "number" in the expression "The main number". In addition, the pitch contour should indicate to the listener that "main" is to be contrasted with "auxiliary". which occurred earlier in the message. To achieve this it was desirable to emulate what would be transcribed in the speech science literature as a L+H* pitch accent. This was achieved by prepending a "pitch rise" marker before the word "main". In addition, in order to achieve a sufficiently steep pitch fall after the word "main" (to what in the literature would be called a L- phrase accent), rather than a gradual fall across the deaccented "number", it was necessary to explicitly insert a marker after "main" that the manufacturer intends to mark the starts of verb phrases. Thus:

The main [[) nahmbrr]] is . . .

Slow speaking of telephone numbers

In message 1, the caller already knows the number 914 555 1020. It as the caller who typed it in, and so the caller will quickly recognize it and will certainly not need to transcribe it. The main number, by contrast, is new information. The caller did not know it, and so will need it spoken more slowly and carefully. This is also true for the last telephone number in the message.

According to the synthesize's manual, the recommended way to achieve this is to (i) slow down the speaking rate, and then (ii) separate the digits with commas or periods to force the synthesizer to insert pauses between them, In the preferred embodiment, however, it was found that explicitly specifying a slow speech rate interfered with the overall adaptation of the speaking rate to the users (a separate feature of the invention), Therefore a different method was used to place pauses between the digits. Specifically, the synthesizer's "spelling mode" was enabled for the duration of the telephone number, and "silence phonemes" (encoded as an underscore: __) were inserted to lengthen the appropriate pauses, This capitalizes on the fact that the mount of silence specified by a silence phoneme depends on the current speaking rate. Thus:

[[:se]]914 [[__ __ __ __]]555 [[__ __ __ __]]19 [[__ __ __ __]]87, [[__ __:sd]]

Note that: (i) the last four digits are spoken as two sets of two digits, separated by some silence. Human speakers do this when they know that the telephone number is unfamiliar to the listener and also important. (ii) the period must be located immediately to the fight of the final digit, before the spelling mode is disabled. Otherwise the pitch contour will not be correct.

Lists of undifferentiated words

Sometimes it is necessary to speak a string of words (in the general sense of strings of printable symbols delineated by white space) for which there has been no available indication of their internal information structure, In the case of name fields, this would be a multi-word NAME NUCLEUS with no NAME PREFIX. In the case of an address field, this would be a street address that did not match any known pattern. In these cases, in the careful and deliberate speaking style that is appropriate for the discourse in the preferred embodiment, the words are best spoken clearly and distinctly. In order to achieve this without sounding boring or mechanical, a pattern was chosen that separated the words by a slight pause, varied the pitch contour within each word so that successive words did not have the same tune, and imposed an overall reduction in the pitch range across the duration of the string. This was achieved with the following combinations of markers:

start with [["__]] to temporarily raise the overall pitch range. This technique was described at the beginning of this section.

If the string is two words long, then separate them with a comma and some extra silence phonemes, as in:

[["__]] word1 [[/,__ __]] word2

Note that in the synthesizer's manual the marker for a pitch rise is intended to be placed before a word. It will then cause the default pitch contour for that word to be replaced with a rise. The usage here, however, is not in the manual. Specifically, the marker is placed after the word but before the comma. The default behavior of DECtalk and most other currently-available speech synthesizers is to place a partial pitch fall (perhaps followed by a slight rise) in the word preceding a comma. In this case, this undocumented usage of the pitch rise marker causes the preceding comma-related pitch to not fall so far. Hence it is less disruptive to the smooth flow of the speech. It helps the two words sound to the listener like they are two components of a single related concept, rather than two separate and distinct concepts.

If the string is three words long, then they are separated by somewhat less silence than in the two-word case. In addition, the pitch contour in the middle word differs from the other two by having a pitch-rise indicator in its more conventional usage:

[[" __]] word1 [[/,__/]] word2 [[,__]] word3

If there are more than three words, repeat the pattern for the second word on all except the last word4:

[["__]] word1 [[/,__/]] word2 [[,__/]] word3 [[,__/]] word4 [[,__]] word5

If any word is an initial (e.g. D Robert Ladd or Mary M Poles), add two more silences after that word If a word is a function word, like "of" in the following phrase, then precede it by extra silences and follow it by a "beginning of verb phrase" marker:

[["__]] Department [[/,__ __ __ __ ]] of [[)__ __]] Statistics

Reduced pitch range for an early part of a sentence (for RELATIONAL MARKERS)

The rules for name fields in the preferred embodiment would speak a name such as "Kim Silverman doing business as Silverman Enterprises" as two declarative sentences: "Kim Silverman. Doing business as Silverman Enterprises". The motivation and detailed algorithm for this analysis are described above. Those rules specify, inter alia, that strings such as "doing business as" (called RELATIONAL MARKERS) should be spoken in a lowered overall pitch range. For the DECtalk unit, this is a problem. Specifically, the problem is that the default pitch range declines over the duration of any declarative sentence, and is thus at its maximum during the fast words and at its minimum during the last words. That is exactly the opposite of what is needed in the second of these two sentences. The solution chosen was to:

(i) specify phonetic transcriptions for the RELATIONAL MARKERS (ii) demote the lexical stresses in the words according to their discourse function An additional problem was that, the slight prosodic boundary that is desired between the RELATIONAL MARKER and the subsequent name could not be achieved by a comma, because this would either cause the synthesizer to replace a primary stress in the preceding string, or interfere with the pitch and duration within that string. Consequently a third component to the solution was to postfix a "beginning of verb phrase" marker followed by silences.

For the second of the above declarative sentences, this resulted in:

[[duwixnx b'ihznixs aez) __ __ __ ]] Silverman Enterprises

Note that this not only reduced the pitch range of the first few words, but also made them quieter and increased their speaking rate.

Clarified initials

When telephone operators speak initials over the telephone, they sometimes lengthen the distinctive obstruent portion. This prosodic readjustment emphasizes for the listener that part of the letter which is unique, thereby minimizing the likelihood of confusions. For example "Paul Z Smith" would be spoken as "Paul Zzzee Smith". This is not the behavior of the synthesizer's default prosody rules, and so needed to be overridden.

This was achieved by a lookup table which is accessed when initials are spoken. It substitutes a phonetic transcription for certain letters, with the prosodic adjustments achieved by judicious insertion of extra phonemes in the transcriptions. Thus, for example, the voice onset time of the voiceless stop at the start of P or T is lengthened by inserting and /h/phoneme between the stop release and the vowel onset:

P→[[phx'iy]]

T→[[thx'iy]]

In a similar way, the frication is lengthened in C, F, S, V, and Z. For example:

C→[[ss'iy]]

S→[['ehss]]

This is also done for the nasal consonants in N and M.

To reduce X being confused with either S or "eck", the stop is lengthened as well as the fricative:

X→[['ehkkss]]

Information-cueing boundaries

As noted in the rules for names and addresses, in the preferred embodiment, sometimes prepositions or phrases are inserted in the synthesis, and they are prosodically treated as if they were in the text. In such case, they are treated in conjunction with the associated text in a prosodic sense that may be different from the phrase content if it were not inserted. Moreover, the described approach for the name and address field prosody involves a new boundary, type for implementation of synthetic speech. That is, that information units preceded by prepositions or other markers indicating or pointing to contextually important information (e.g. "the main number is" or "is listed to" in previous examples) are sought by the software, and then, between the information and the preposition or marker, a pause for the right hand edge of the preposition or marker is called for by the rule. In this approach, no emphasis on the preposition or marker is made, nor is it lengthened, nor is there a pitch change before a pause. The text to the left of the pause is not lengthened as much as it would be before any other type of pause.

As described elsewhere in the Detailed Description, such pauses are inserted to alert the listener that the next words contain important information, rather than to indicate a structural division between phrases, constituents, or concepts. These pauses differ phonetically from other types of pauses in that they are preceded by little or no lengthening of the preceding phonetic material, and in particular do not seem to be accompanied by any boundary-related pitch changes.

Commercial devices in general do not easily lend themselves to producing this class of prosodic pauses, probably because they have not yet been thoroughly explored or sufficiently described in the research literature. Although their phonetic correlates are not well understood in the general case, this does not preclude modelling them explicitly within a particular application. In the preferred embodiment this was possible because they were needed in known places. However since there is no formal such item in the synthesizer's repertoire different techniques were needed to emulate them in different contexts.

On of them was needed immediately before the name in strings such as: "That number is listed to Kim Silverman". Neither a comma nor a period achieved the desired result, and so a phonetic transcription was used. To avoid incorrect pitch changes, no explicit boundary marker would be placed on the fight. This left explicit silence phonemes as the only possible way to insert a pause. But this in turn caused the wrong duration to occur on the word "to", and so the synthesizer's default duration had to be explicitly overridden on that vowel:

914 555 1234 is [[lihstixd tuw<140>__ __ __]] Kim Silverman.

A different case was the prepositions that preceded street addresses and towns. For example:

Kim Silverman. At 500 John Street. In Dover.

The rules desired to introduce such attention-mustering pauses after the "at" and the "in". Each of these two prepositions needed different treatment to achieve the desired result. The solutions were:

[[__+'aet __ __]] Note the secondary stress on the preposition and in [[)__ __]] In this case the preposition receives the default stress applied by the synthesizer.

The former case needed only silence phonemes on the fight, whereas the latter also needed a "beginning of verb phrase" marker—the ")".

Low final endpoints

The end of a discourse turn or other prosodic paragraph needs to be marked by a reduced pitch range, and if that discourse turn ends in what would be transcribed as a L % (low final boundary tone) then that needs to be lower than any preceding such tones in the same prosodic paragraph. There is no documented way to lower the bottom of the speaker's pitch range for the device used in the current embodiment, other than by changing the standard deviation of pitch. But this has the undesirable consequence of increasing the top of the range at the same time. However an undocumented method was found: namely postfixing a double period, followed by a space, in phonetic transcription at the right hand edge of the prosodic paragraph. This will not work if the double period is expressed in normal orthography. Thus for example (omitting the effects of other rules for the sake of simplicity and clarity):

Kim Silverman. Doing business as Silverman Enterprises. In Boston. [[. . ]

Testing of the preferred embodiment has shown that even in such simple material, as names and addresses domain-specific prosody can make a clear improvement to synthetic speech quality. The transcription error rate was more than halved, the number of repetitions was more than halved, the speech was rated as more natural and easier to understand, and it was preferred by all listeners. This result encourages further research on methods for capitalizing on application constraints to improve prosody. The principles of the invention will generalize to other domains where the structure of the material and discourse purpose can be inferred. Thus it is to be appreciated that while the invention has been discussed in the context of a relatively detailed preferred embodiment, the invention is susceptible to a range of variation and improvement in its implementation which would not depart from the scope and spirit of the invention as may be understood from the foregoing specification and the appended claims.

What is claimed is:

1. A method of synthesizing speech from a series of characters representing an address, the series of characters including a plurality of address components including a street address component, each address component including at least one word where a word is any mixture of printable nonblank characters, the method comprising the steps of:

analyzing a first word of a street address component to determine if the first word includes only digits;

if it is determined that the first word includes only digits analyzing a second word in the street address component to determine if the second word includes only alphabetic characters, or is a digit string followed by at least one letter;

if it is determined that the first word includes only digits, and the second word includes only alphabetic characters, inserting, between the first and second words, a prosodic boundary including a pause having a first duration;

if it is determined that the first word includes only digits, and the second word includes digits followed by at least one letter, inserting, between the first and second words, a prosodic boundary including a pause having a second duration that is longer than the first duration; and generating speech from the series of characters representing the address and any inserted prosodic boundaries.

2. The method of claim 1, wherein the plurality of address components further includes a post office box component which includes a number, the method further comprising the step of:

generating speech from the post office box component by performing the steps of:

i. synthesizing audible speech corresponding to the phrase "post office box" with the most stress within said phrase being assigned to the word post, the least stress within the phrase being assigned to the word office and an intermediate amount of stress to the word box, and ii. synthesizing audible corresponding to the number included in the post office box component.

3. The method of claim 2, further comprising the step of;

deaccenting the word street if it is included as the last word of the street address component.

4. The method of claim 3, wherein the series of characters further includes characters representing a name, the method further comprising the step of:

inserting a pause between the characters representing the name and the characters representing the address.

5. The method of claim 4, further comprising the step of:

determining the duration of the pause inserted between the characters representing the name and the characters representing the address as a function of the complexity of the represented name.

6. The method of claim 4, wherein the characters representing the name include multiple words, the method further comprising the step of:

determining the duration of the pause inserted between the characters representing the name and the characters representing the address as a function of the number of words included in the characters representing the name.

7. The method of claim 6, wherein the duration of the pause inserted between the characters representing the name and the characters representing the address, is longer for names including multiple words than it is for names including fewer words.

8. The method of claim 7, wherein the plurality of address components further includes a zip code component, the method further comprising the step of:

treating the zip code component as a single word declarative sentence when generating speech therefrom.

9. The method of claim 2, wherein the plurality of address components further includes a zip code component, the method further comprising the step of:

treating the zip code component as a single word declarative sentence when generating speech therefrom.

10. A method of synthesizing speech from a first series of characters representing a name and a second series of characters representing an address, the series of characters representing the name and the series of characters representing the address each including at least one word where a word is any mixture of alphanumeric nonblank characters, the method comprising the steps of:

determining, as a function of the complexity of the represented name, the length of a pause to be inserted between the series of characters representing the name and the series of characters representing the address;

inserting a pause of the determined length between the series of characters representing the name and the series of characters representing the address; and generating speech from the series of characters representing the name and the address as a function of the inserted pause.

11. The method of claim 10, wherein the series of characters representing the name includes a plurality of words; and wherein the complexity of the represented name is a function of the number of words included in the series of characters representing the name.

12. The method of claim 11, wherein the duration of the inserted pause is determined to be longer for names represented using several words as compared to names represented using fewer words.

* * * * *